US005631600A

United States Patent [19]

Akioka et al.

[11] Patent Number: 5,631,600

[45] Date of Patent: May 20, 1997

[54] REFERENCE CURRENT GENERATING CIRCUIT FOR GENERATING A CONSTANT CURRENT

[75] Inventors: Takashi Akioka, Hitachi; Kinya Mitsumoto, Tamamura-machi; Yutaka Kobayashi, Hitachinaka, all of Japan

[73] Assignee: Hitachi, Ltd., Tokyo, Japan

[21] Appl. No.: 361,722

[22] Filed: Dec. 23, 1994

[30] Foreign Application Priority Data

Dec. 27, 1993 [JP] Japan ..... 5-331002
Dec. 27, 1993 [JP] Japan ..... 5-331034

[51] Int. Cl.[6] ..... G05F 3/02

[52] U.S. Cl. ..... 327/543; 327/538; 327/546; 327/513

[58] Field of Search ..... 327/538, 543, 327/545, 546, 513

[56] References Cited

U.S. PATENT DOCUMENTS

| | | | |
|---|---|---|---|
| 5,001,362 | 3/1991 | Tran . | |
| 5,352,934 | 10/1994 | Khan | 327/538 |
| 5,391,980 | 2/1995 | Thiel et al. | 327/539 |
| 5,394,026 | 2/1995 | Yu et al. | 327/539 |
| 5,430,395 | 7/1995 | Ichimaru | 327/538 |
| 5,440,277 | 8/1995 | Ewen et al. | 327/538 |

*Primary Examiner*—Terry Cunningham
*Attorney, Agent, or Firm*—Antonelli, Terry, Stout & Kraus, LLP

[57] ABSTRACT

A constant current generating circuit is provided with a first current generating circuit unit which generates a first current having a positive temperature dependency and includes a pair of first and second bipolar transistors, a first current mirror circuit comprised of a plurality of first MOS transistors which regulates a current density ratio of the currents fed to the first and second bipolar transistors to be constant and derives the first current and a first circuit disposed between the first and second bipolar transistors and the first current mirror circuit for limiting dependency of the currents flowing through the first and second bipolar transistors on a voltage of a power source applied to the first current mirror circuit, a second current generating circuit unit is also provided which generates a second current having as negative temperature dependency and which includes a third bipolar transistor and a second resistor through which the second current is derived. Also, a summing current generating circuit unit is provided which sums the first current and the second current and generates a constant current with substantially no temperature dependency representing the summed current. This summary current generating circuit unit includes a second current mirror circuit comprised of a plurality of second MOS transistors which generates the constant current representing the summed current.

4 Claims, 21 Drawing Sheets

VCC
PROPORTIONAL CURRENT SUPPLY 3
M7
VEE
CURRENT GENERATING CIRCUIT UNIT HAVING CANCELLED OUT TEMPERATURE DEPENDENCY
VCC
CS1
Q4
R3
VEE
CURRENT GENERATING CIRCUIT UNIT HAVING NEGATIVE TEMPERATURE DEPENDENCY
VCC
PROPORTIONAL CURRENT SUPPLY 1
PROPORTIONAL CURRENT SUPPLY 2
Q2
Q1
R1
VEE
CURRENT GENERATING CIRCUIT UNIT HAVING POSITIVE TEMPERATURE DEPENDENCY

PROPORTIONAL CURRENT SUPPLY 4
PROPORTIONAL CURRENT SUPPLY 5
Vcc
Vcc
Vcc
M7
VEE
CS1
Q4
R3
VEE
Q1
Q1
Q1
Q1
Q2
R1
VEE
CURRENT GENERATING CIRCUIT UNIT HAVING CANCELLED OUT TEMPERATURE DEPENDENCY
CURRENT GENERATING CIRCUIT UNIT HAVING NEGATIVE TEMPERATURE DEPENDENCY
CURRENT GENERATING CIRCUIT UNIT HAVING POSITIVE TEMPERATURE DEPENDENCY

FIG. 20

DC CHARACTERISTIC (RL=50Ω, VTT=-2.0V)

| ITEM | SYMBOL | min | typ | max | UNIT |
|---|---|---|---|---|---|
| OUTPUT VOLTAGE | VOH | -1025 | -955 | -880 | mV |
| | VOL | -1810 | -1715 | -1620 | mV |
| INPUT VOLTAGE | VIH | -1165 | | -880 | mV |
| | VIL | -1810 | | -1475 | mV |

IDEAL MOS STATIC CHARACTERISTIC

ACTUAL MOS STATIC CHARACTERISTIC

VD: DRAIN VOLTAGE

VG: GATE VOLTAGE

IDS: DRAIN CURRENT

REFERENCE CURRENT GENERATING CIRCUIT FOR GENERATING A CONSTANT CURRENT

BACKGROUND OF THE INVENTION

1. Field of the Invention

The present invention relates to a semiconductor integrated circuit and more specifically relates to a current generating circuit suitable for generating a reference current which is particularly constant with respect to ambient temperature and power source voltage.

2. Description of the Prior Art

In a semiconductor integrated circuit it is sometimes required to have a constant current which is independent from external conditions such as variations in power source voltage and ambient temperature. JP-A-62-293327(1987) discloses a measure of obtaining a constant current with respect to ambient temperature in a CMOS LSI. FIG. 9 shows the circuit arrangement thereof, in which with a first current mirror circuit which operates in a weak inversion region of a MOS transistor and with a second current mirror circuit which operates in a strong inversion region of MOS transistor, a current having a positive temperature dependency and a current having a negative temperature dependency are respectively generated and by adding the two types of currents, a circuit which generates a current having a reduced temperature dependency in comparison with the respective individual currents.

Further, in a conventional LSI for an ECL (Emitter Coupled Logic) interface a band gap reference circuit was used for fulfulling the specification of potential levels at the input and output. An example of the conventional reference signal generating circuits is disclosed in Journal of Solid State Circuits, Vol. SC-8, No. 5, 1973 October, pp 362–367. FIG. 10 shows the constant voltage generating circuit for fulfilling the ECL specification disclosed in the above paper, in which bipolar transistors Q1 and Q2 and a resistor element R1 generate a current having a positive temperature dependency and by flowing the generated current through a resistor element R11 a voltage having positive temperature dependency is generated between both ends of the resistor element R11. By adding the generated voltage and a base-emitter voltage of the bipolar transistor Q2, a voltage independent of temperature is obtained. In this instance, for producing a summed voltage of these two voltages it is necessary to connect the bipolar transistors and the resistor elements. When the voltage obtained by the addition can be subsequently applied to a resistor element, a current independent from temperature is obtained. However, since voltages of about 0.5 V or more for a resistor element R10, 0.8 V or more for respective bipolar transistors Q10, Q11 and Q2 and about 0.5 V for the resistor element R11 are at least required for their operation, a power source voltage of at least about 3 V is required for between the VCC node and the VEE node in order for the circuit to correctly operate as intended.

In the drawings of the present application circle marks denote a power source node at a high potential side (referred to as VCC) and triangle marks denote a power source node at a low potential side (as called VEE).

The problems of the above explained conventional art are that a constant current generating circuit, which generates a constant current without being affected by variations such as of ambient temperature and of power source voltage, and which operates at a high accuracy which fulfills the ECL specification while requiring only a low power source voltage of about 3 V, can not be achieved. In particular, in the conventional ECL circuit the resistor element R11 and the bipolar transistor Q2 or the resistor element R12 and the bipolar transistor Q1 and the like are connected in series, therefore the operating speed thereof is regulated by the constant power source voltage. Further, the above circuit proposed for a CMOS LSI has a problem with regard to accuracy which is insufficient for applying to the ECL LSI. Because of the specification with regard to the input and output potential levels in a LSI for the ECL interface, a current source which generates a reference current is necessary in the integrated circuit. In the conventional LSI for the ECL interface the specification was fulfilled by making use of by a reference signal generating circuit called as an ECL 100k power source circuit. An example of such conventional circuits is disclosed in Journal of Solid State Circuits, Vol. SC-22, No. 1 pp 71–76. FIG. 19 shows a 100k ECL output buffer circuit constituted by making use of the conventional 100k ECL power source circuit as disclosed in the above paper. Further, FIG. 20 shows the ECL 100k specification wherein RL represents a resistor provided between the output terminal and an output termination potential (VTT=–2.0 V) and all of the volatges are determined with reference to potential of VCC.

The structure of the conventional 100k ECL output buffer circuit is explained with reference to FIG. 19. The circuit is divided into a reference voltage generating circuit unit and a 100k ECL output buffer circuit unit. Through bipolar transistors Q1 and Q2 and a resistor element R1 in the reference voltage generating circuit unit surrounded by a dotted line in the drawing the collector current of the bipolar transistor varies depending upon temperature. When the current flows through a resistor element R10, a voltage having the same temperature dependency as the collector current is generated between both ends of the resistor element R10. For adding this generated voltage and the base-emitter voltage of the bipolar transistor Q2 the bipolar transistor Q2, and the resistor element R10 are connected in series. The added voltage is generated between VEE (power source terminal at a lower voltage side) and VCS in the drawing when the base-emitter voltages of the bipolar transistors Q22 and Q24 are equivalent. The 100k ECL output buffer circuit receives the generated voltage and generates a voltage output which is compatible with the ECL 100k standard.

In the above conventional art, since it is necessary to connect the bipolar transistor Q2, the resistor element R10 and the like in series as explained in the above, there was a problem that the circuit could not operate normally under a low power source voltage of about 3 V or less.

SUMMARY OF THE INVENTION

An object of the present invention is to provide a constant current generating circuit which can be operated with a low power source voltage of about 3 V or less and exhibits a reduced temperature dependency.

Another object of the present invention is to provide a constant current generating circuit which can be operated with a low power source voltage and which suppresses fluctuation due to variation of temperature and of power source voltage.

Still another object of the present invention is to provide a reference current generating circuit which shows no or limited output characteristic change due to variation of power source voltage and of ambient temperature, and which can be operated with a low power source voltage, and to provide a constant current generating circuit using the same.

A feature of the present invention is to comprise two sets of PN junctions of which current density ratio is kept constant, wherein a differential voltage having a positive temperature dependency is produced from voltages generated at respective both ends of the PN junctions, a first current generating circuit unit having a positive temperature dependency characteristic which generates a current depending on the above differential voltage, and a second current generating circuit unit having a negative temperature dependency characteristic which generates a current depending on a voltage having a negative temperature dependency characteristic generated between both ends of the PN junctions.

Further, a feature of the present invention is to comprise a summing current generating circuit unit which generates a constant current depending on a summing current of the current having a positive temperature dependency characteristic and the current having a negative temperature dependency characteristic, wherein the above summing current generating circuit unit is designed to generate a predetermined summing current by making use of a drain current ratio of two or more sets of MOS transistors of which both the sources and the gates are respectively connected each other.

In the constant current generating circuit according to the present invention, since the measure of generating a summing current of the current having a positive temperature dependency characteristic and the current having a negative temperature dependency characteristic is used, the necessity of connecting a voltage generating element having a positive temperature dependency characteristic and another voltage generating element having a negative temperature dependency characteristic for creating the summing voltage is eliminated which was required in the conventional ECL use power source circuit, thereby the constant current generating circuit according to the present invention can be operated with a lower power source voltage than that for the conventional circuit.

Another feature of the present invention is to comprise an absolute temperature proportional current generating unit which produces an absolute temperature proportional current proportional to an ambient absolute temperature, a proportional current generating unit which generates a proportional current proportional to the absolute temperature proportional current and a control unit which detects variation of a power source voltage and controls proportional current generating unit depending on the detected variation, thereby the variation of the power source voltage is controlled and a reference current which is proportional to the absolute temperature is produced.

Still another feature of the present invention is to comprise a proportional current generating unit which is constituted by a plurality of MOS transistors of which sources and gates are respectively connected each other and two sets of bipolar transistors, wherein the collector current ratio of the two sets of the bipolar transistors is controlled to a predetermined ratio and a current proportional to an ambient absolute temperature and depending upon the difference voltages between base and emitter of the two sets of the bipolar transistors is generated.

Still another feature of the present invention is that the proportional current generating unit detects the power source voltage and controls the drain voltages of the plurality of MOS transistors of which sources and gates are respectively connected each other based on the detected power source volatge so as to prevent relative variation of the drain voltages.

Still another feature of the present invention is to comprise a reference current generating circuit unit which is constituted by using the reference current generating circuit, a current source unit constituted by making use of MOS transistors and an ECL buffer circuit unit, wherein the output potential level of the ECL buffer circuit unit is controlled depending on the current proportional to the absolute temperature which is produced by the reference current generating circuit unit.

Still another feature of the present invention is to comprise a reference current and reference voltage generating unit in which the base of a first bipolar transistor and the base of a second bipolar transistor are connected each other, the emitter of the first bipolar transistor and the emitter of the second bipolar transistor are connected via a resistor unit having a predetermined electrical resistance value and a differential voltage between the base-emitter voltage of the first bipolar transistor and the base-emitter voltage of the second bipolar transistor is applied to the resistor unit, and a power source voltage fluctuation absorbing unit constituted by MOS transistors connected to the respective collectors of the first and second bipolar transistors so as to maintain the current ratio of the collector current flowing through the first bipolar transistor and the collector current flowing through the second bipolar transistor at a predetermined current ratio.

With the above explained features of the present invention the following advantages are obtained.

The absolute temperature proportional current generating unit is designed to be independent from the power source voltage and ambient temperature which are relatively set constant each other by means of the drain voltages of the two MOS transistors which are used for obtaining a constant current ratio and of which sources and gates are respectively connected each other.

The absolute temperature proportional current generating circuit is constituted by two bipolar transistors (one bipolar transistor can be constituted by connecting respective bases, collectors and emitters of a plurality of bipolar transistors), a resistance element and means for keeping the ratio of the collector currents of these two bipolar transistors constant. The means for keeping constant the ratio of the collector currents is constituted by MOS transistors of which sources and gates are respectively connected each other. Through the two MOS transistors of which sources and gates are respectively connected each other the differential voltage between the base-emitter voltages of the two bipolar transistors of which collector current ratio is kept constant is applied to the resistance element, thereby a current value flowing through the resistance element is determined. The drain voltages of the MOS transistors in general vary depending on fluctuation of the power source voltage. However, the drain volatges of these MOS transistors are set so as not to vary relatively between the MOS transistors. Namely, the drain voltages of the MOS transistors of which sources and gates are respectively connected each other are designed to vary in accordance with variation of the power source volatge.

Generally, when the drain voltage varies due to an early effect of an MOS transistor, the drain current thereof also varies. The early effect of an MOS transistor is explained with reference to FIG. 21A through FIG. 21C. As illustrated in FIG. 21B, when the gate voltage VG is constant, the drain current IDS of MOS transistor is ideally constant and independent from the drain voltage VD in the sturation region of sufficiently high drain voltage VD. However, in actual MOS transistors the drain current shows a dependency on the drain voltage as illustrated in FIG. 21C.

Accordingly, when the drain voltage of a plurality of MOS transistors of which sources and gates are respectively connected each other are set so as to vary relatively and in a same manner, the ratio of currents flowing through these MOS transistors is not affected by the variation of the power source voltage. Accordingly, even when the power source voltage varies, the ratio of currents flowing through the bipolar transistors never varies so that the currents flowing through these bipolar transistors vary in proportion to the ambient temperature.

The fact that the differential voltage between the base-emitter voltages of the two bipolar transistors of which collector current ratio is kept constant varies in proportion to an ambient absolute temperature can be explained based on physical characteristics of the bipolar transistors. When the differential voltage is applied to the resistance element, the current value of the current flowing through the resistance element also varies in proportion to the ambient absolute temperature.

Accordingly, the influence of the power source voltage fluctuation is extremely limited and a current which is proportional to an ambient absolute temperature is produced with a low power source volatge.

Other objects and advantages of the present invention will become apparent from the detailed description to follow taken in conjuction with the appended claims.

BRIEF DESCRIPTION OF THE DRAWINGS

These and other objects, features and advantages of present invention will be understood more clealy from the following detailed description with reference to the accomoanying drawings, wherein:

FIG. 20 shows an ECL 100k standard;

DESCRIPTION OF THE PREFERRED EMBODIMENTS

Figure 8:
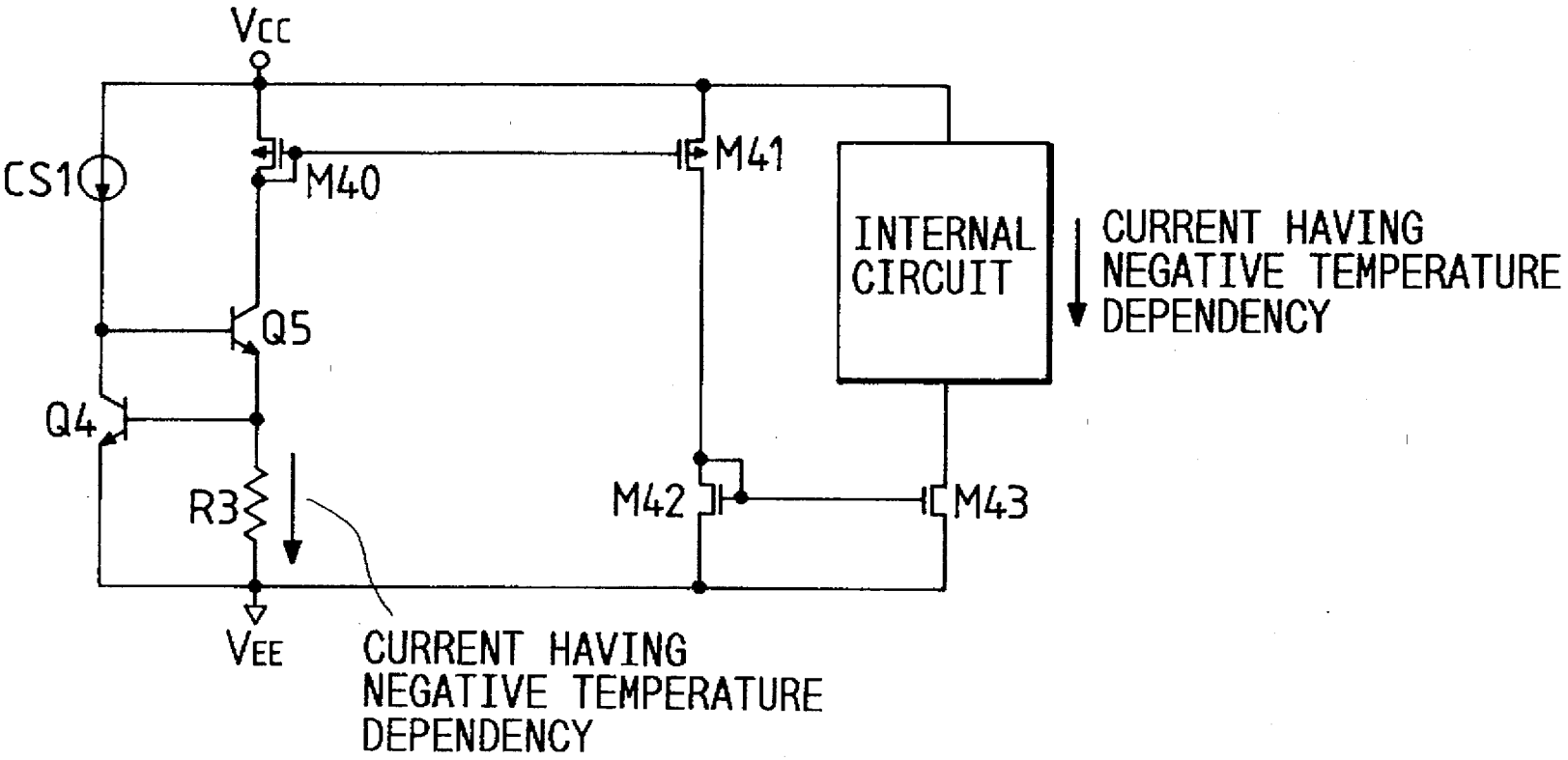
FIG. 8 shows a constant current generating circuit which makes use of the VBE of a bipolar transistor.

In LSIs such as BiCMOS LSIs using bipolar transistors, a method of generating a constant voltage by making use of the base-emitter voltage (hereinafter simply called as VBE) of such bipolar transistors is known. FIG. 8 shows an example of power source circuits using VBE voltage of bipolar transistors.

The circuit is one which makes use of a current generated through application to a resistance element R3 of VBE voltage which is generated at the PN junction between the base-emitter of the bipolar transistor Q4 when a forward current is flowed therethrough as a reference current. A bipolar transistor Q5 is provided for suppressing an influence of the voltage applied to the resistance element R3 on the gate voltage of a MOS transistor M40. The base potential of the bipolar transistor Q4 is determined with reference to VEE potential, and the gate potential of the MOS transistor M40 is determined with reference to VCC potential. A current source CSI is an appropriately selected current source. Since a dependency of VBE voltage of a bipolar transistor on the emitter current is small, a dependency of the current value of the current source CSI on the power source voltage is negligible. MOS transistors M40 and M41, and MOS transistors M42 and M43 constitute current mirror circuits and cause to flow through their internal circuits a current proportional to the current flowing through the resistance element R3.

Although, a dependency of VBE voltage on the magnitude of emitter current of a bipolar transistor is small, a dependency thereof on an ambient temperature is comparatively large (generally about 2mV/°C., in that about 0.2 V variation is induced in a temperature span of 100° C.), for and, this reason when a constant current with respect to an ambient temperature variation as well as a power source voltage variation is required, the FIG. 8 circuit cannot be used.

Figure 1:
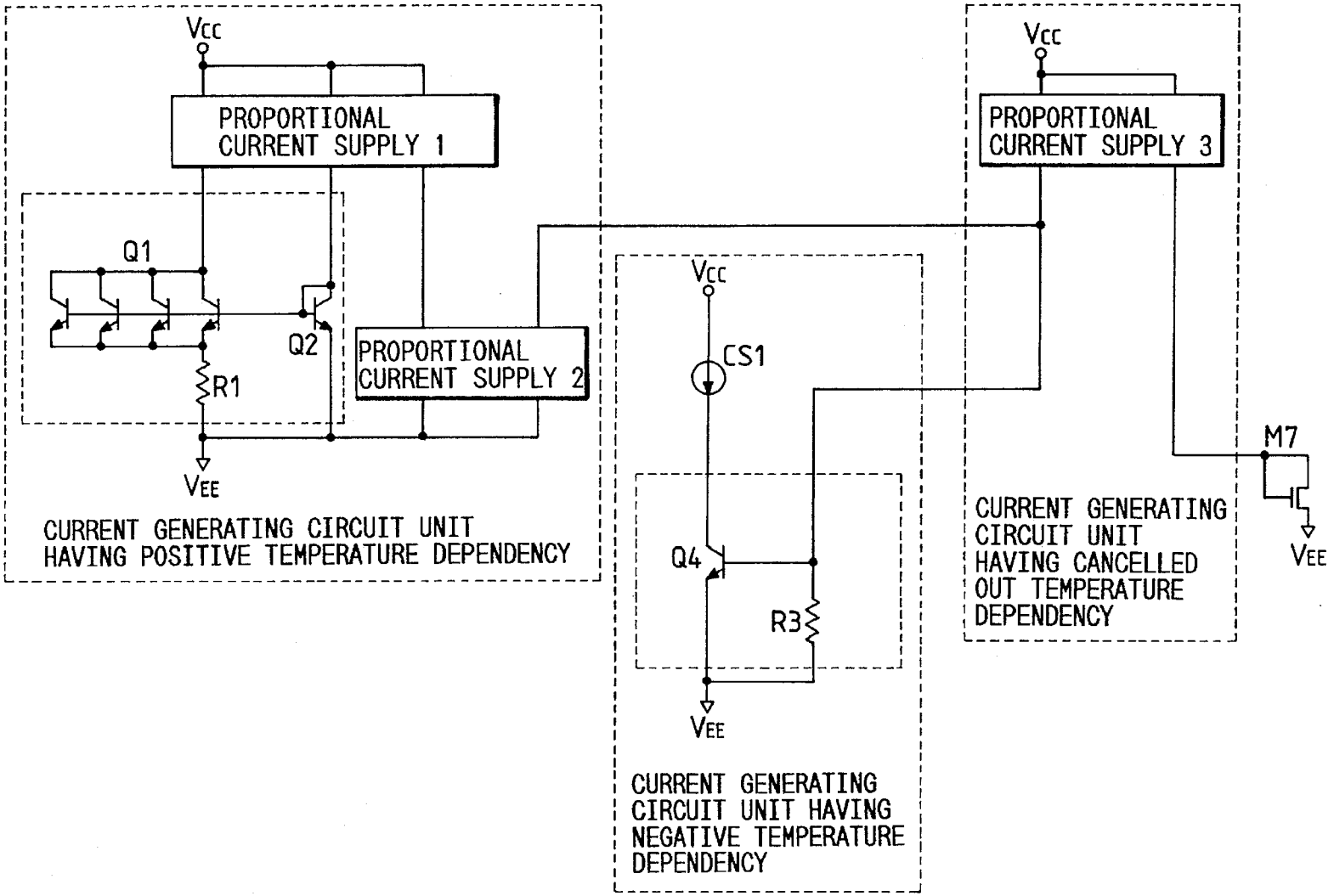
FIGS. 1 to 7 show various embodiments of constant current generating circuits according to the present invention.
Figure 9:
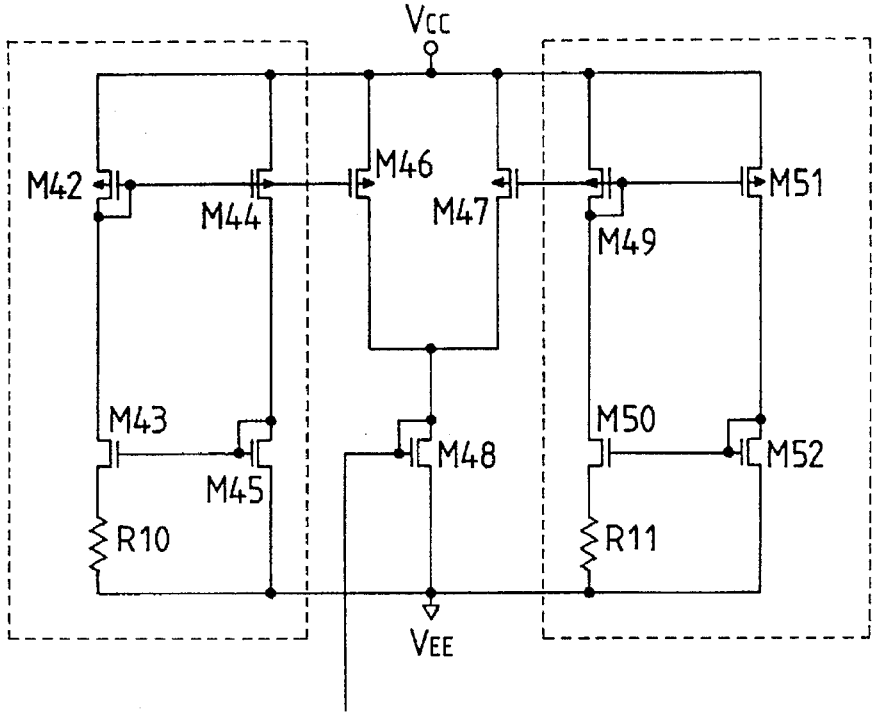
FIG. 9 PRIOR ART
FIG. 9 shows a conventional constant current generating circuit.

An embodiment of the present invention is shown in FIG. 1. VBE voltage of a bipolar transistor shows a predetermined negative dependency with respect to ambient temperature. It is well known in the art concerned that since a dependency of VBE voltage with respect to variation of manufacturing process condition (process variation) of LSI devices is small in comparison with such as threshold voltage VTH of a MOS transistor, a stable characteristic can be easily realized by making use of bipolar transistors better than MOS transistors. Namely, there is an advantage that with the FIG. 1 circuit using bipolar transistors a more stable characteristic is realized than with the conventionally proposed FIG. 9 circuit.

The circuit illustrated in FIG. 1 includes roughly classified three parts, namely "a current generating circuit unit having a positive temperature dependency", "a current generating circuit unit having a negative temperature dependency" and "a current generating circuit unit having a cancelled out temperature dependency". The "current generating circuit unit having a positive temperature dependency" is composed by bipolar transistors Q1 and Q2, a proportional current supplying means for keeping the ratio of emitter currents of these bipolar transistors constant, a resistance element R1 to which VBE voltages of the bipolar transistors Q1 and Q2 are applied and another proportional current supplying means which supplies a current proportional to the current flowing through these bipolar transistors. With this structure a differential voltage of VBE voltages of the bipolar transistors Q1 and Q2 is applied to the resistance element R1. Since VBE voltages of bipolar transistors of which emitter current ratio is kept constant vary in proportion with ambient absolute temperature, a current proportional to an ambient absolute temperature flows through the proportional current supplying means. In FIG. 1 embodiment, the bipolar transistor Q1 is constituted by four unit bipolar transistors.

The "current generating circuit unit having a negative temperature dependency" is composed by a resistance element R3, a bipolar transistor Q4 and a current source CSI. Since a dependency of the VBE voltage of the bipolar transistor Q4 on the power source voltage is small, there arise no problems as explained above even when there exists some dependency of the current supplied from the current source CSI on the power source voltage. Since a voltage generated between both ends of the forwardly biased PN junction shows a negative temperature dependency, a voltage having a negative temperature dependency is applied between both ends of the resistance element R3 and thereby a current having a negative temperature dependency flows through the resistance element R3.

The "current generating circuit unit having a cancelled out temperature dependency" has a function to create a summing current of the currents generated in the above two circuit units. Since it is possible to equalize the absolute values of temperature dependency coefficients with regard to currents generated by the "current generating circuit unit having a positive temperature dependency" and the "current generating circuit having a negative temperature dependency" by adjusting variables such as resistance values, thereby with the FIG. 1 circuit a constant current in which a temperature dependency is cancelled out can be obtained.

When the output current is received by MOS transistor M7 of which gate and drain are short-circuited as illustrated in FIG. 1, a drain current with no temperature dependency can flow through the MOS transistor M7.

Figure 10:
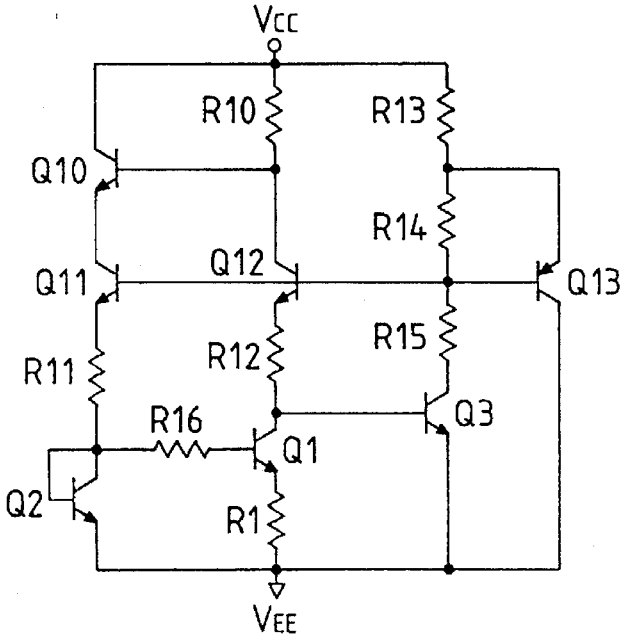
FIG. 10 PRIOR ART
FIG. 10 shows another conventional constant current generating circuit.
Figure 11:
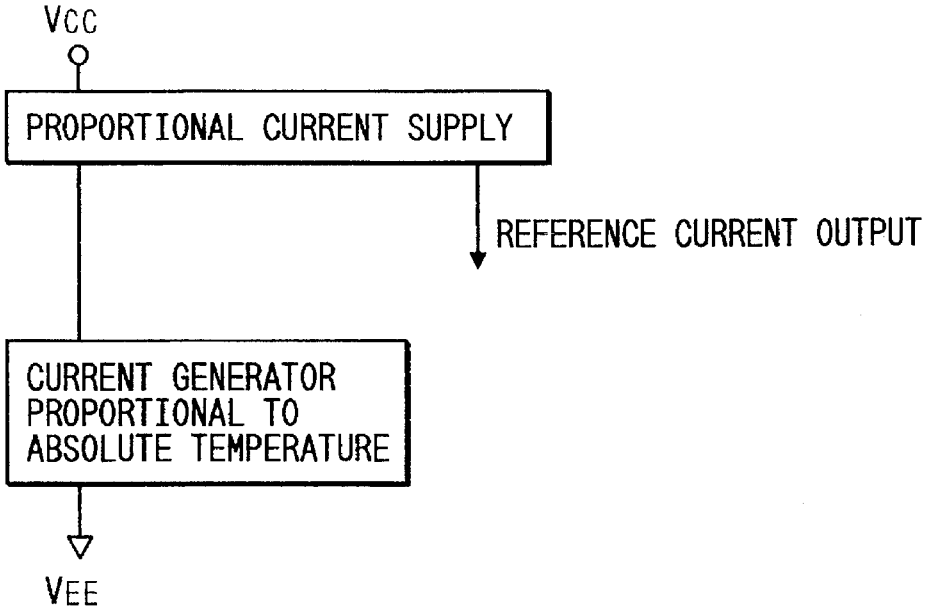
FIG. 11 shows an example in block diagram from of reference current and reference voltage generating circuits according to the present invention wherein no power source voltage fluctuation absorbing means is included.
Figure 12:
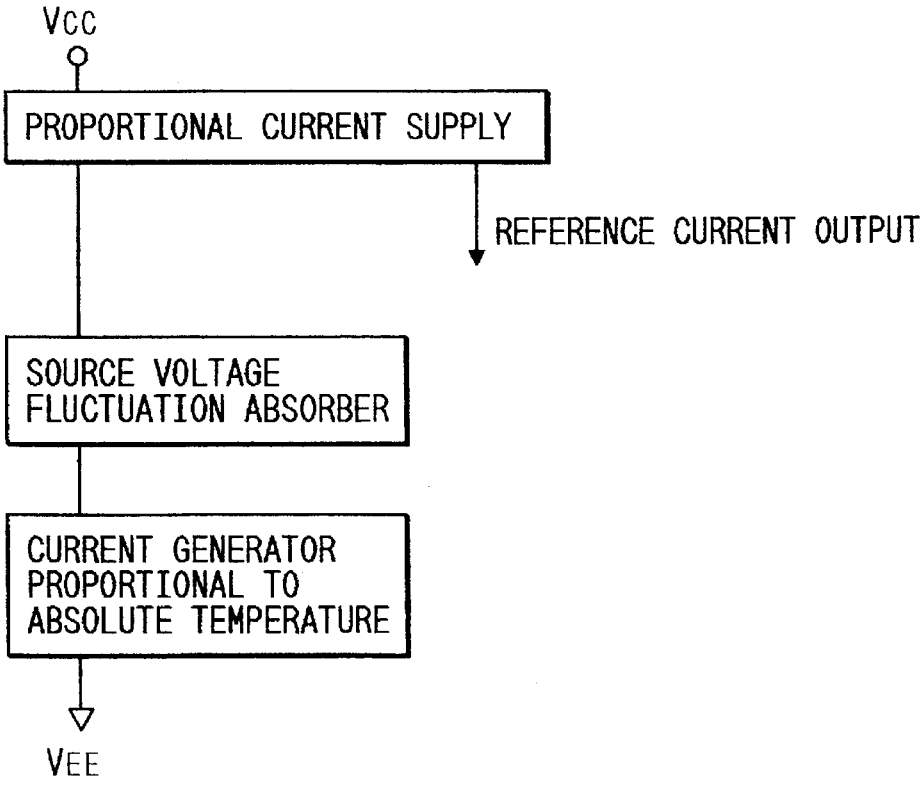
FIG. 12 shows another example in block diagram of reference current and reference voltage generating circuits according to the present invention wherein a power source voltage fluctuation means is included.

In FIG. 1 circuit, since there are no portions generating a band gap voltage (about 1.3 V) having no temperature dependency, a constant current generating circuit which can be operated with a lower power source voltage than that of the conventional circuit, in which a band gap voltage as illustrated in FIG. 10 is generated and the generated band gap voltage is applied to the resistance element to obtain a constant current, and is independent from ambient temperature is realized.

Figure 2:
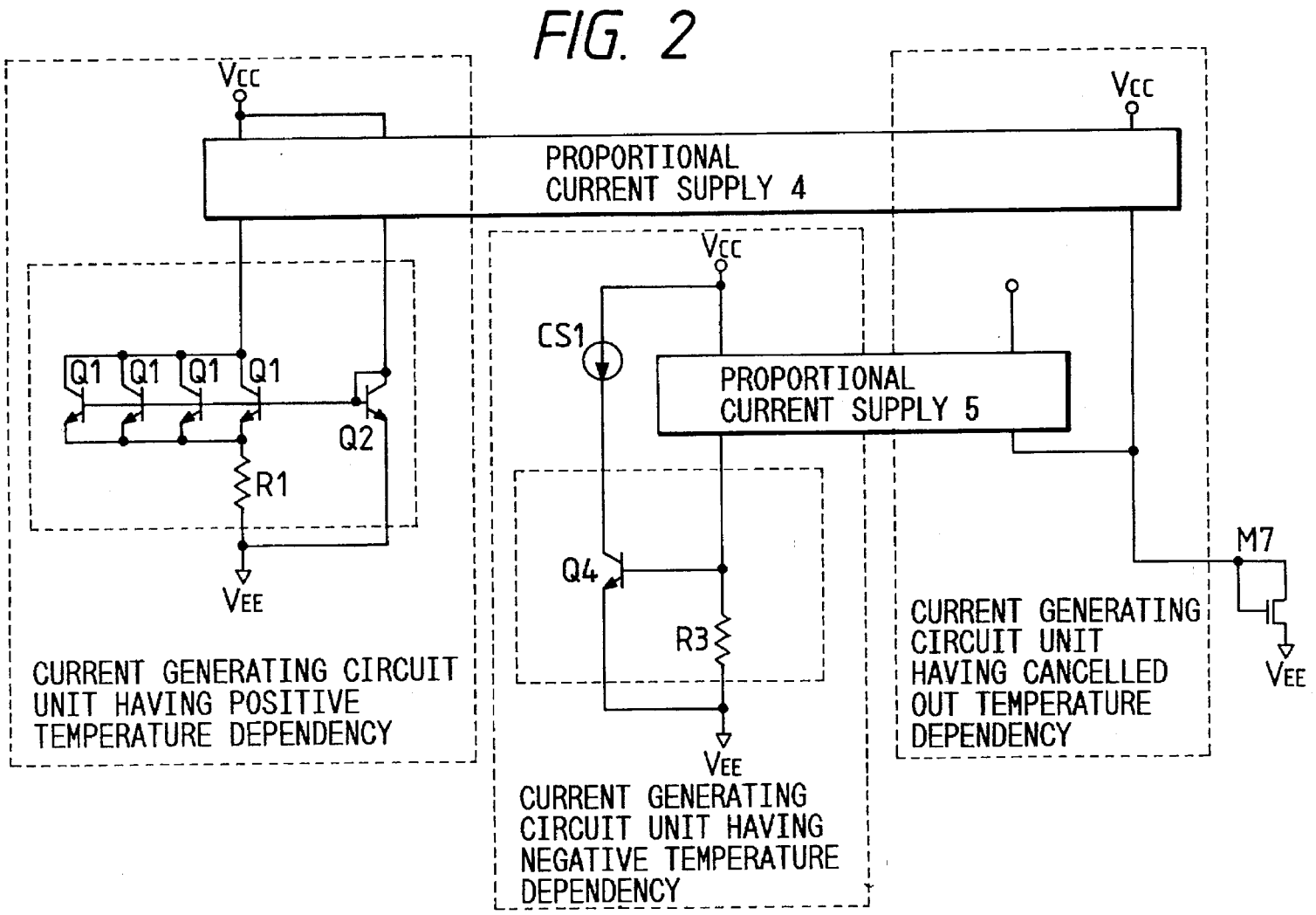

FIG. 2 shows another embodiment of the present invention. A difference of the FIG. 2 circuit from the FIG. 1 circuit is that when creating a summing current of a current having a positive temperature dependency and a current having a negative temperature dependency, the currents are directly supplied to the MOS transistor M7 which is designed to supply current by making use of a proportional current supply means 4 and a proportional current supply means 5.

With the FIG. 2 circuit, when outputting current to the MOS transistor M7 which necessitates a constant current source, the number of proportional current supply means is reduced in comparison with the FIG. 1 circuit, thereby the structure of the circuit is simplified.

Figure 3:
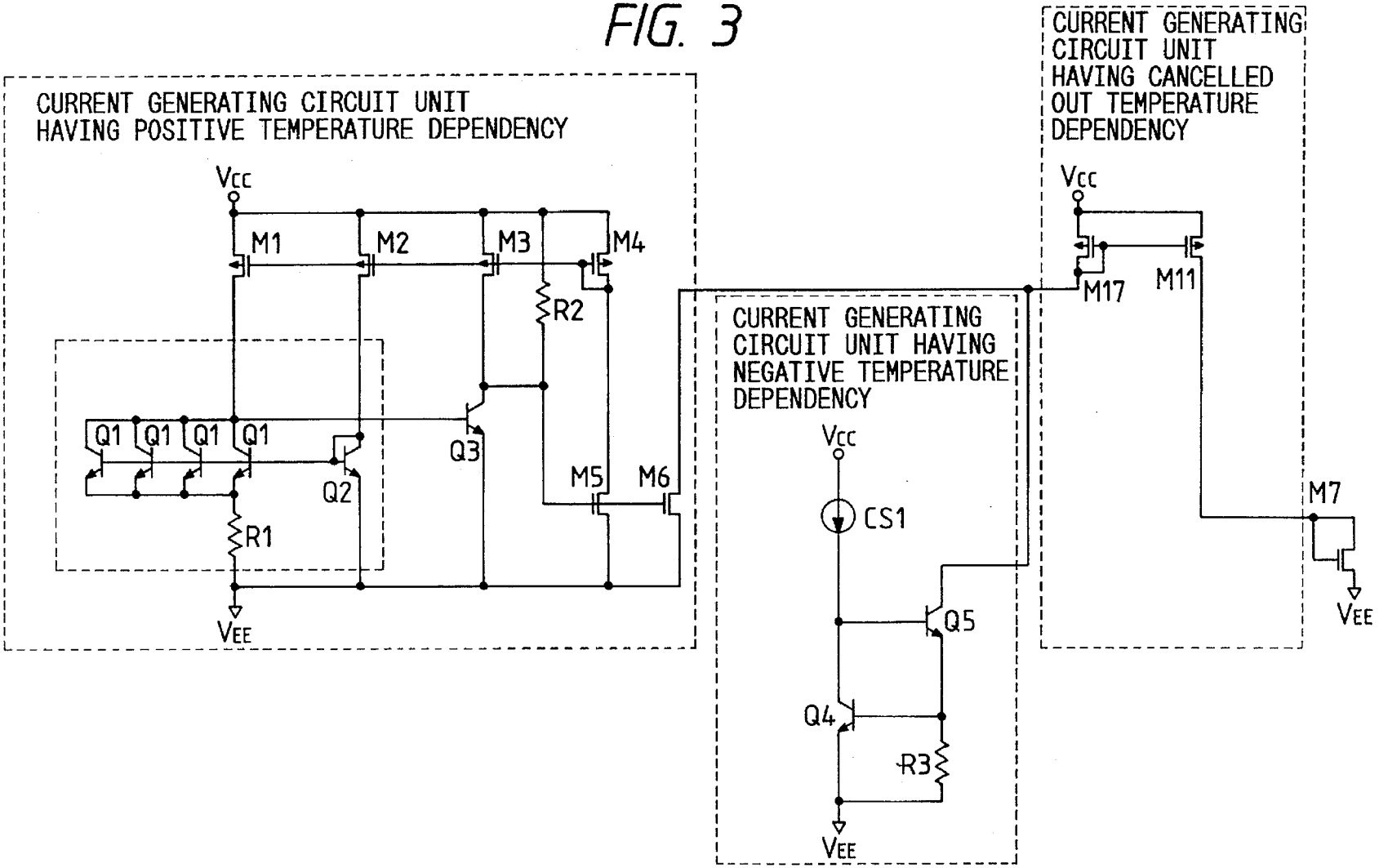

FIG. 3 shows an embodiment of the present invention presenting more specifically of the FIG. 1 circuit wherein the proportional current supplying means as illustrated in FIG. 1 are constituted by MOS transistors. With MOS transistors M1, M2, M3 and M4 the proportional current supplying means 1 as illustrated in FIG. 1 is constituted, with MOS transistors M5 and M6 the proportional current supplying means 2 is constituted and with MOS transistors M17 and M18 the proportional current supply means 3 is constituted. A bipolar transistor Q3, a resistance element R2 and MOS transistors M3 and M5 operate as explained below, and thereby a dependency on power source voltage of the current flowing through the bipolar transistors Q1 and Q2 is effected to be reduced. When the collector potential of the bipolar transistor Q1 rises due to influence such as the power source voltage, through the function of an amplifier constituted by the bipolar transistor Q3, the resistance element R2 and the MOS transistor M3, the collector voltage of the bipolar transistor Q3 drops, the gate voltage of the MOS transistor M5 drops and the current flowing through the MOS transistor M5 decreases. Thereby, the current flowing through the MOS transistor M4 also decreases, such that the absolute value of the gate voltage of the MOS transistor M4 decreases, the gate voltage of the MOS transistor M4 varies toward VCC side and the resistance of the MOS transistor M1 increases, thereby the collector voltage of the bipolar transistor Q1 drops which operates to suppress the above initial rise of the collector potential of the bipolar transistor Q1. Accordingly, the currents flowing through the MOS transistors M4 and M5 vary in proportion to ambient absolute temperature but cancel out each other with respect to fluctuation of the power source voltage.

Since a current proportional to one for the MOS transistor M5 flows through the MOS transistor M6, a current which is independent from the power source voltage but proportional to ambient absolute temperature is created. Further, a current having a negative temperature dependency flows through the resistance element R3. The bipolar transistor Q5 is added so as not to affect the drain voltage of the MOS transistor M17 on the voltage applied to the resistance element R3. Namely, the VBE voltage of the bipolar transistor Q4 is applied to the resistance element R3 regardless to the collector voltage of the bipolar transistor Q4. Accordingly, when the circuit constants are adjusted so that the respective currents flowing through the MOS transistor M6 and the resistance element R3 cancel out their temperature dependencies, a summing current having no temperature dependency and no power source voltage dependency is obtained at the MOS transistor M17. Further, a current proportional thereto also flows through the MOS transistor M18, thereby a current having no temperature dependency and no power source voltage dependency is obtained at the MOS transistor M7.

With the present embodiment, a constant current generating circuit in which both the temperature dependency and the power source voltage dependency are cancelled out is realized.

Figure 4:
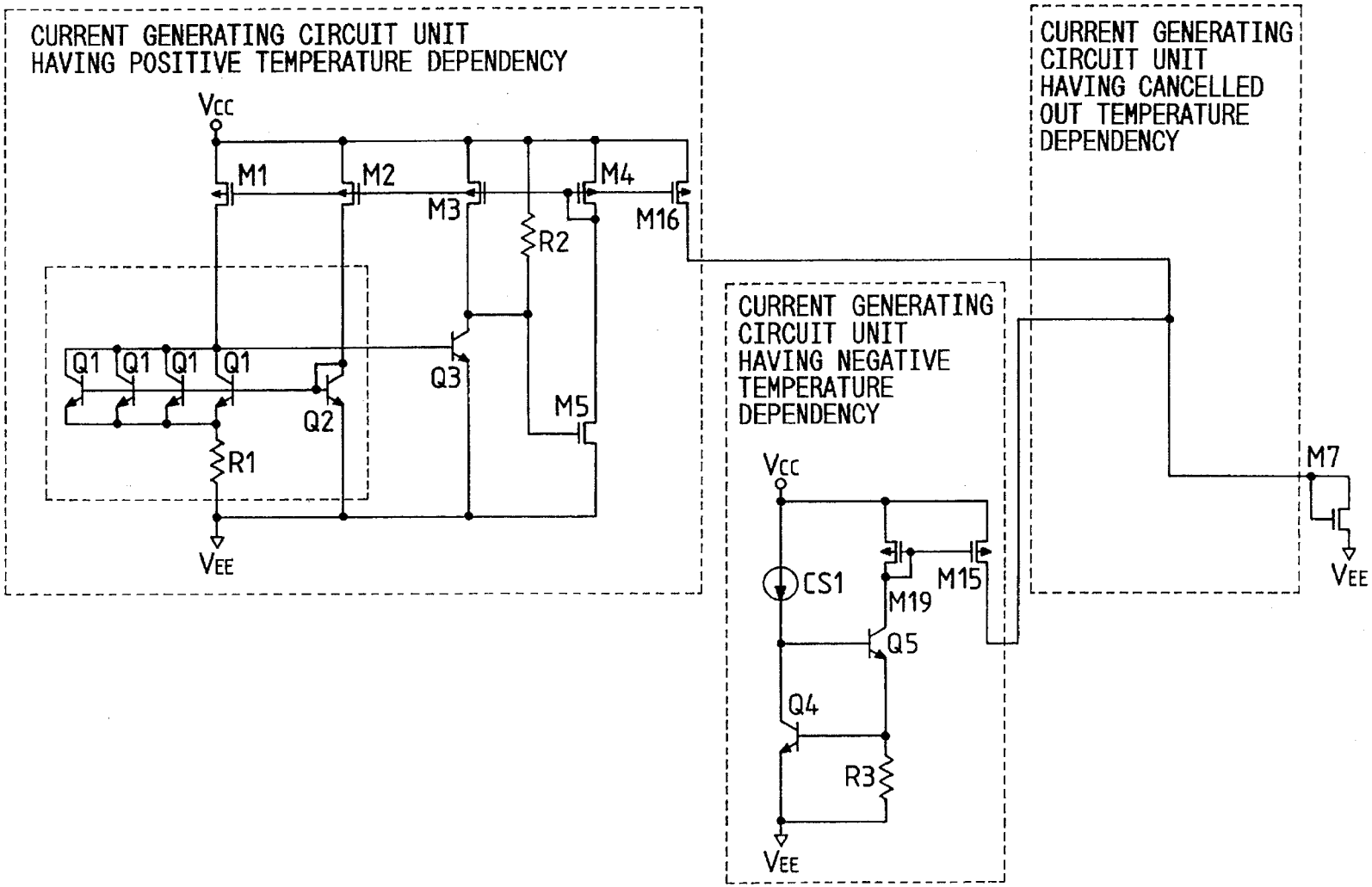

FIG. 4 shows an example presenting more specifically of the FIG. 2 circuit wherein the proportional current supplying means as illustrated in FIG. 2 are constituted by MOS transistors. With MOS transistors M1, M2, M3, M4 and M16 the proportional current supplying means 4 is constituted and with MOS transistors M15 and M19 the proportional current supplying means 5 is constituted. The reason why the bipolar transistor Q3, the MOS transistors M3 and M5 and the resistance element R2 eliminate the power source voltage dependency of the current generated at the MOS transistor M4 is the same as in the FIG. 3 embodiment. Accordingly, with the present embodiment a current having a positive temperature dependency and no power source voltage dependency is obtained at the MOS transistor M16. Further, a current generated at the current generating unit having a negative temperature dependency flows through the MOS transistor M15, therefore when the circuit constants which cancel out the temperature dependencies of these two currents are set, the temperature dependency and the power source voltage dependency of the current flowing through the MOS transistor M7 are eliminated.

Figure 5:
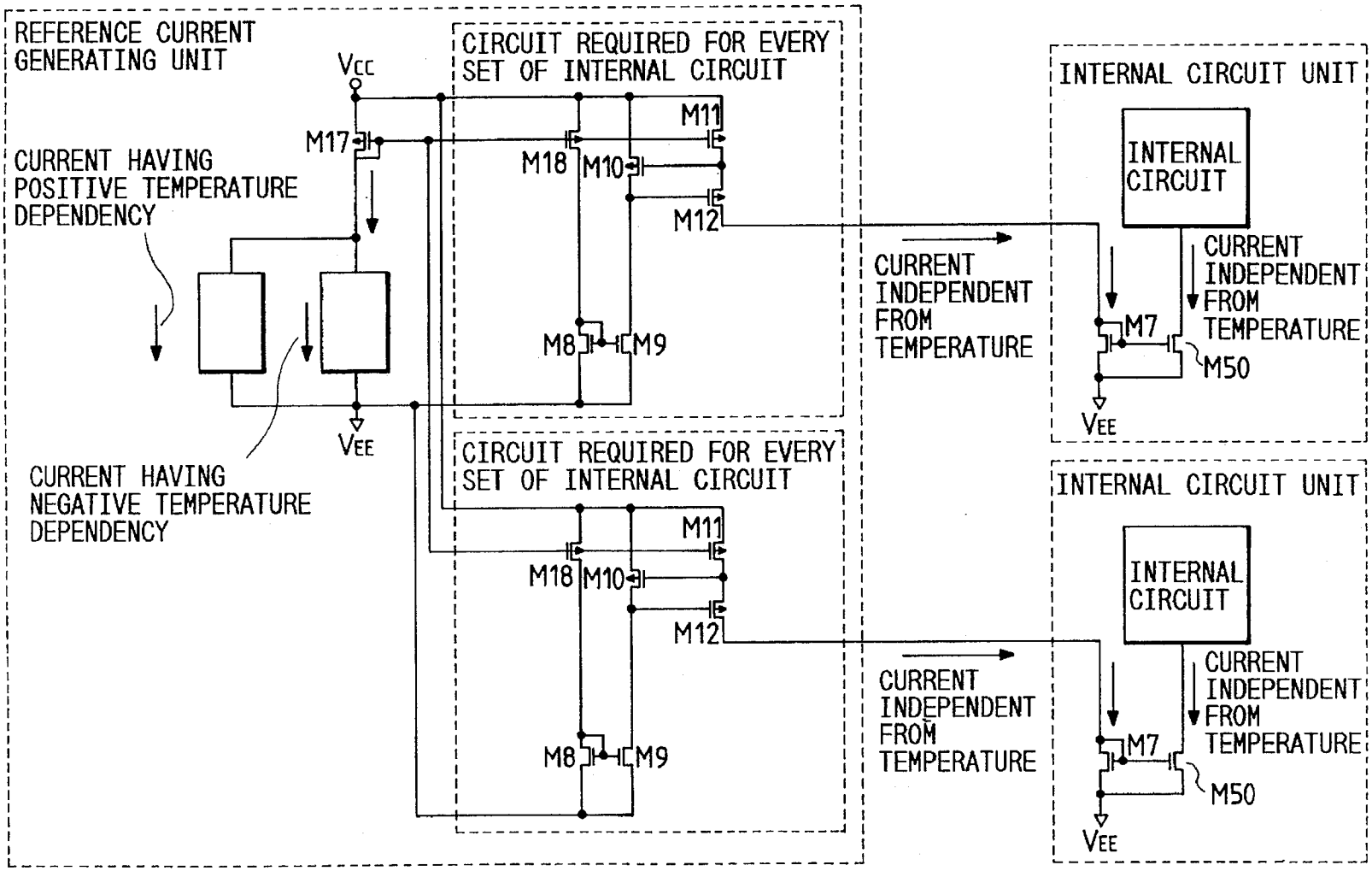

FIG. 5 shows an example in which a regulated cascode current mirror circuit is applied in the present invention circuit. In the FIG. 3 and FIG. 4 circuits, no attention is paid to the drain voltages of the MOS transistors of which gates and sources are commonly connected respectively. For example, in the MOS transistors M17 and M11 in FIG. 3 the drain voltages of these two MOS transistors are determined separately, namely the drain voltage of the MOS transistor M17 is determined with reference to VCC potential and the drain voltage of the MOS transistor M11 is determined with reference to VEE potential, therefore the drain voltages of these MOS transistors vary due to power source voltage fluctuation or a parasitic resistance of a signal line from the MOS transistor M11 to the MOS transistor M7. Even with MOS transistors which operate in their saturation regions and of which respective sources and gates are connected to each other, the drain currents thereof vary depending on variation of their drain voltages which is referred to as an early effect of a MOS transistor. When ideal MOS transistors with no early effect are used, the FIG. 3 and FIG. 4 circuits show no power source voltage dependency of their output characteristics. However, when MOS transistors of which early effects are not negligible are used, the early effects of the respective MOS transistors are cancelled out with the FIG. 5 circuit.

The operation of the FIG. 5 circuit is hereinafter explained. Now, assuming an example when a current proportional to one flowing through the MOS transistor M17 flows through the MOS transistor M7, since a current proportional to one flowing through the MOS transistor M17 flows through the MOS transistor M18, a current proportional to one flowing through the MOS transistor M17 also flows through the MOS transistors M8 and M9 which are connected in a current mirror circuit and the MOS transistor M10 which is connected is series with the MOS transistor M9. Accordingly, the gate voltage of the MOS transistor M10 varies in a similar tendency as with the gate voltage of the MOS transistor M17, and since the gate of the MOS transistor M10 is connected to the drain of the MOS transistor M11, the drain voltages of the MOS transistors M17 and M11 vary in a similar tendency. Accordingly, the drain currents of the MOS transistors vary in proportion regardless to the power source voltage.

Since the output characteristic of the FIG. 5 embodiment circuit is not affected by the early effect of the MOS transistor, with the present embodiment circuit a constant current having no dependency on power source voltage as well as ambient temperature is obtained.

Further, when a single such reference current generating unit is provided in a LSI chip, the constant current signal can be supplied to respective "internal circuit units" existing in a plurality of locations in the LSI chip. A number of circuits, each consisted of a set of six MOS transistors M18, M8, M9, M10, M11 and M12, corresponding to number of "internal circuit unit" in the LSI chip are necessitated. FIG. 5 illustrates an example wherein the current source is connected for two internal circuits.

Namely, with the FIG. 5 circuit structure, when there are a plurality of internal circuits which require respective constant sources, it is not necessary to provide the usual necessary number of entire constant current source circuits if the necessary number of limited circuit portions for the respective internal circuits are prepared, thereby the corresponsing number of excluded circuit portions are reduced.

Figure 6:
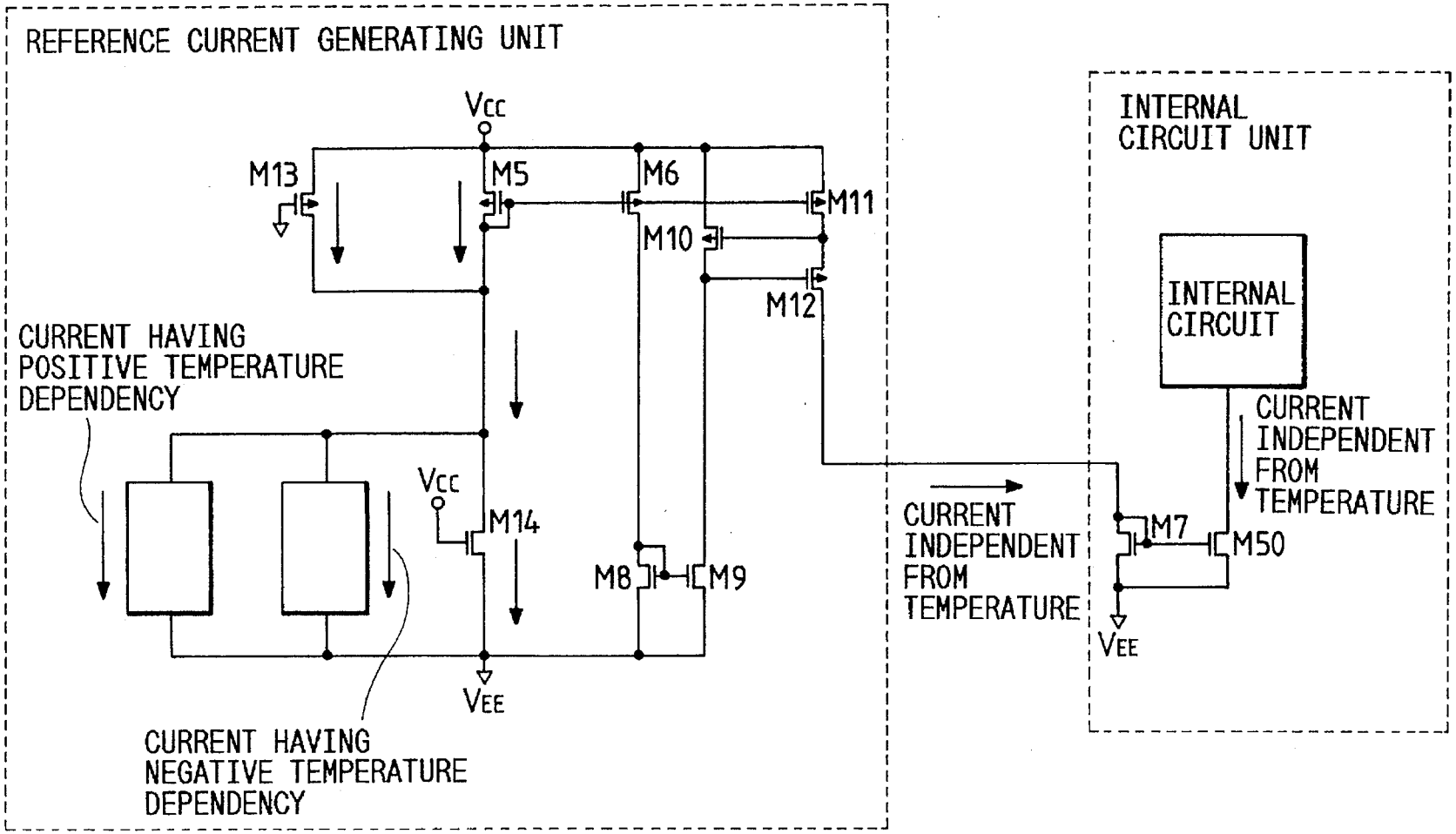

FIG. 6 shows another embodiment of the present embodiment. The reference current generating unit as illustrated in FIG. 6 is the same as the fundamental portion of the current generating circuit having no power source voltage dependency as illustrated in FIG. 5. MOS transistors M17, M18, M8, M9, M10, M11 and M12 constitute a current mirror circuit between the MOS transistors M17 and M11 as illustrated in FIG. 5 which are not affected by the early effect of the MOS transistor, thereby a current proportional to one flowing through the MOS transistor M17 also flows through the MOS transistor M7. With the present embodiment, a parasitic resistance, if any, of a signal line transmitting a current to the MOS transistor M7 affects no influence on the drain voltage of the MOS transistor M11, therefore a power source voltage dependency of the current flowing through the MOS transistor M7 is eliminated.

In the FIG. 5 circuit, a current having no power source voltage dependency flows through the MOS transistor M7, however, the drain voltages of the MOS transistors M7 and M50, in general, differ from each other, therefore in order to eliminate an influence due to early effect between these MOS transistors it is necessary to provide a regulated cascode current mirror circuit between the MOS transistors M7 and M50. However, in a case when there are many internal circuits which require a constant current, with the FIG. 5 circuit structure number of circuit elements may increase greatly.

FIG. 6 shows a circuit structure in which a current which is to be flown through the MOS transistor M7 is provided in advance with a negative inclination with respect to variation of the power source voltage and as a result, a current having a limited influence of the power source voltage is flown through the MOS transistor M50, which is realized by the MOS transistors M13 and M14. Namely, a constant current of which both dependencies with respect to power source voltage and to ambient temperature are cancelled out is flown in a divided manner through the MOS transistors M13 and M17, and when the power source voltage rises, the resistance of the MOS transistor M13 of which gate is grounded decreases and the drain current thereof increases, thereby a current flowing through the MOS transistor M17 decreases. Contrary, since the resistance of the MOS transistor M14 decreases when the power source voltage lowers, a current flowing through the MOS transistor M17 increases. Through adjustment of these two MOS transistors a power source voltage dependency can be provided on the current flowing through the MOS transistor M7. More specifically, since the drain voltage of the MOS transistor M50 is determined with reference to VCC, for example, when in response to a power source voltage rise an increase of the drain voltage of the MOS transistor M50 is large in comparison with that of MOS transistor M7, and the drain current of the MOS transistor M50 increases accordingly, therefore if a negative dependency with respect to the power source voltage is provided on the current flowing through the MOS transistor M7, the power source voltage dependency of the drain current of the MOS transistor M50 can be resultantly decreased.

According to the FIG. 6 embodiment, through addition of a current having a power source voltage dependency to a summing current of a current having a positive temperature dependency and a current having a negative temperature dependency, a power source volatge dependency can be provided on the added current, thereby a power source voltage dependency of the reference current is cancelled out which can be caused during transmission of the reference signal to current sources in respective internal circuits, and thus a constant current generating circuit which eliminates a power source voltage dependency in respective internal circuits using the reference current is constituted by a comparatively small number of circuit elements.

Figure 7:
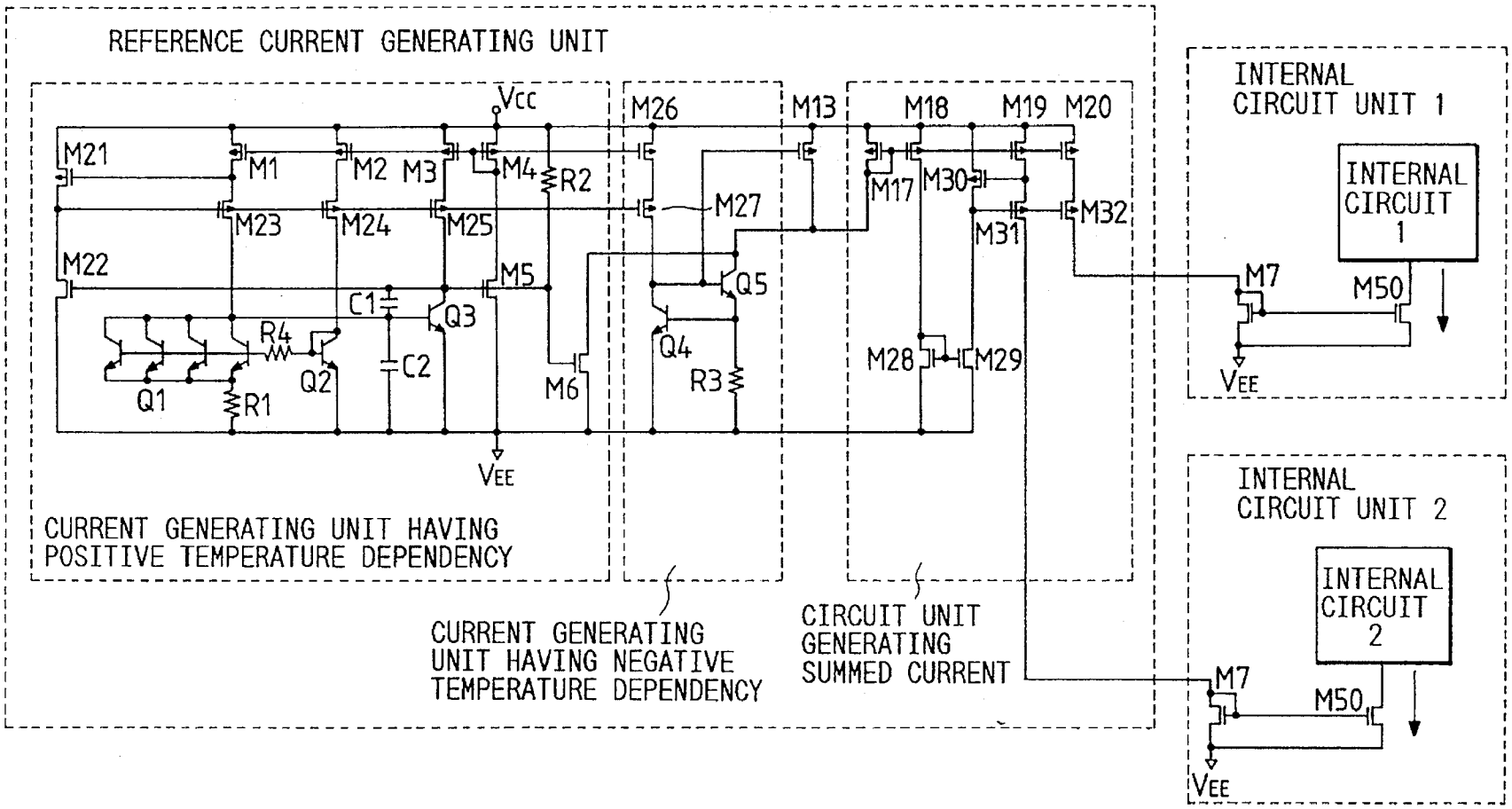

FIG. 7 shows another embodiment including a constant current generating circuit, power source circuits for a LSI using the same and internal circuits using the constant current according to the present invention. Although the reference current generating unit is fundamentally the same as the current generating units as illustrated in FIG. 3 and FIG. 4, however, the power source voltage dependency of the reference current generating unit is further improved. When early effect of the MOS transistors M1, M2, M3 and M4 in the circuits as illustrated in FIG. 3 and FIG. 4 is not negligible, through addition of MOS transistors M21, M22, M23, M24 and M25 the influence due to the early effect of the MOS transistors M1, M2 and M3 is eliminated. Namely, since a current proportional to ones flowing through the MOS transistors M5, M4, M3, M2 and M1 flows through the MOS transistor M22, a current proportional to one flowing through the MOS transistor M1 also flows through the MOS transistor M21, thereby the gate potential of the MOS transistor M21 varies depending on the gate and drain voltage of the MOS transistor M4. Namely, the drain voltage of the MOS transistor M1 is provided of the same tendency with respect to the drain voltage of the MOS transistor M4 and the power source voltage, thereby the fluctuation due to variation of the power source voltage of the ratio of the currents flowing through the MOS transistors M1 and M4 is eliminated. Accordingly, an influence due to power source voltage variation on the current ratios between the MOS transistors M2, M3 and M4 is eliminated through the provision of the MOS transistors M24 and M25.

Although in the FIG. 6 embodiment the gate terminal of the MOS transistor M13 is grounded to VEE, the terminal can be connected to any nodes as illustrated in FIG. 7, if the node shows a proper power source voltage dependency, the terminal connection is determined in such a manner that the characteristic of the current flowing through the MOS transistor M50 with respect to variation of the power source voltage is resultantly cancelled out.

In the FIG. 6 embodiment only one internal circuit is illustrated for one reference current generating unit, however a plurality of internal circuit units can be provided for one reference current generating unit as illustrated in FIG. 7, in which two internal circuit units are illustrated however any number of internal circuit units more than one can be provided. A set of MOS transistors such as M19 and M31 is provided for one MOS transistor M7. Although only one MOS transistor M50 is illustrated for one MOS transistor M7 in one internal circuit, a plurality of MOS transistors M50 can be provided for one MOS transistor M7 in one internal circuit.

The present embodiment can normally operate even when the power source potentials of the reference current generating unit and the internal circuit units differ to some extent, namely the potentials of VCC and the potentials of VEE differ to some extent. Namely, since a current signal is transmitted from thr reference current generating unit to the internal circuit units and no gate voltage signal of the MOS transistors is transmitted, for example, there arise no problems even when the source potential of the MOS transistor M7 differs from VEE potential of the reference current generating unit. However, for example, when the source voltages of MOS transistors in an internal circuit unit differ each other, the current values flowing therethrough are affected, such that it is necessary to keep the potential such as VEE in an internal circuit constant. Further, the same is true in a reference current generating circuit unit itself.

The resistance element R4 in FIG. 7 functions in the same manner as the resistance element R16 in the conventional circuit shown in FIG. 10. The resistance element R4 can be disposed as illustrated in FIG. 7. Namely, with such arrangement of the resistance element R4 a variation of amplifier performance caused by variation due to production process of the bipolar transistor Q2 is suppressed.

A static capacitor C1 in FIG. 7 functions to prevent an oscillation of an amplifier circuit constituted by the bipolar transistor Q3, the resistance element R2 and the MOS transistor M3. Further, a static capacitor C2 also functions to stabilize the base potential of the bipolar transistor Q3 and to prevent the oscillation thereof.

Further, the current source CSI as illustrated in FIG. 3 is realized by the MOS transistors M26 and M27.

With the above construction, the current from the current source CSI shows no power source voltage dependency and the power source voltage dependency of the consumption current of the constant current generating circuit itself can be limited.

According to the present embodiment a constant current generating circuit in which a power source voltage dependency of the constant current induced by early effect of MOS transistor is suppressed.

Further, according to the present embodiment, it is enough if a single reference current generating unit is provided in an LSI chip so that the number of circuit elements in the LSI chip is reduced. Still further, a current signal is transmitted between the reference current generating unit and the internal circuit unit, an accuracy of the generated constant current is not affected even when Potentials at power source node differ each other.

As explained above, according to the present embodiments, a constant current generating circuit which can be operated with a lower power source voltage than that in the conventional circuits and shows no dependencies both with respect to ambient temperature and the power source voltage is obtained.

Figure 13:
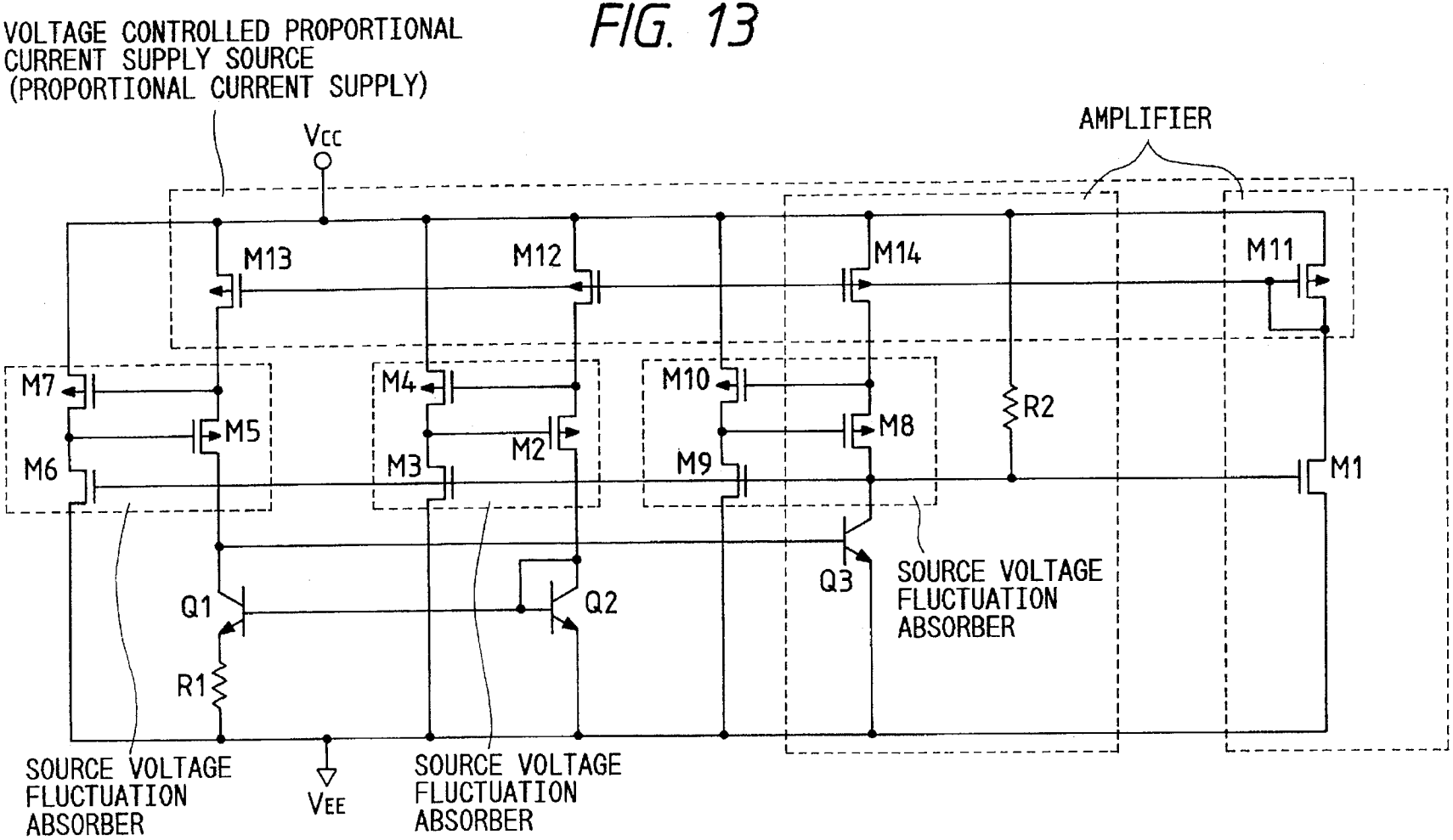
FIG. 13 shows a further example of reference current and reference voltage generating circuits according to the present invention.

FIG. 13 shows another embodiment of the present invention, which eliminates the power source voltage dependency, generates a current proportional to ambient absolute temperature and is operable with a low power source voltage. A circuit constituted by the bipolar transistors Q1 and Q2, the resistance element R1 and the MOS transistors M12 and M13 ideally operates as explained below. Namely, since the bipolar transistor Q1 and the MOS transistor M13 are connected in series, the collector current and the drain current thereof are equalized. Further, since the bipolar transistor Q2 and the MOS transistor M12 one connected in series, the collector current and the drain current thereof are equalized. Now, assuming that the early effect of MOS transistors is neglibile, the ratio of currents flowing through the MOS transistors M12 and M13 is kept constant, thereby the ratio of the currents flowing through the bipolar transistors Q1 and Q2 is also kept constant. In general, since the differential voltage between base-emitter voltages of bipolar transistors of which ratio of the collector currents is kept constant varies in proportion to ambient absolute temperature, the voltage applied to the resistance element R1 varies in proportion to ambient absolute temperature. Accordingly, when neglecting the early effect of MOS transistors, with the MOS transistors M12 and M13, the bipolar transistors Q1 and Q2 and the resistance element R1 a current proportional to an ambient absolute temperature flows through the MOS transistor M13. The MOS transistors M11, M12, M13 and M14 constitute current mirror circuits, cause to flow through respective elements connected in series therewith currents proportional each other and further constitute a proportional current supplying circuit of which current varies in proportion to an ambient absolute temperature.

The MOS transistors M1 and M11 operate in the following manner. Namely, when the collector current of the bipolar transistor Q1 increases by some causes such as power source voltage variation and the collector voltage thereof rises, the base potential of the bipolar transistor Q3 rises, thus the collector potential of the bipolar transistor Q3, in other words the gate potential of the MOS transistor M1 drops. Thereby, currents flowing through the MOS transistors M1 and M11 decrease and the gate voltages of the MOS transistors M12, M13 and M14 which are connected with the MOS transistor M11 in a current mirror circuit decrease to decrease the currents flowing therethrough, which operates to drop the collector potential of the bipolar transistor Q1, induces negative feed back effects for the collector voltage of the bipolar transistor Q1 which is for the first time assumed to be raised, and stabilizes the circuit.

Further, the MOS transistors M2, M3 and M4 operate as explained below so that the variation of the drain potential of the MOS transistor M12 follows the source potential thereof. When the power source voltage rises, the collector potential of the bipolar transistor Q3 likely drops as explained above. Thereby, the gate potential of the MOS transistor M3 drops and the current flowing through the MOS transistor M3 decreases. Thus, the current flowing through the MOS transistor M4 which is connected in series with the MOS transistor M3 decreases and the gate potential thereof drops accordingly, namely, in this instance the gate potential moves toward VCC side, thereby the variation of the drain potential of the MOS transistor M12 can be matched with the variation of VCC. Through the same operation of other MOS transistors M5 through M10 the power source voltage dependencies of the drain current values of the MOS transistors M13 and M14 are eliminated. Thereby, the ratio of collector currents flowing through the bipolar transistors Q1 and Q2 never vary depending upon the power source voltage and the power source voltage dependency of the current generated by the reference current generating circuit is eliminated.

In the reference power source circuit disclosed in our prior application (JP-A-5-233084(1993)) the MOS transistors M2, M3, M4, M5, M6, M7, M8, M9 and M10 are not included, therefore the drain potentials of the MOS transistors M12, M13 and M14 do not vary in accordance with the variation of VCC, accordingly the output current of the circuit can vary depending upon the power source voltage.

Figure 23:
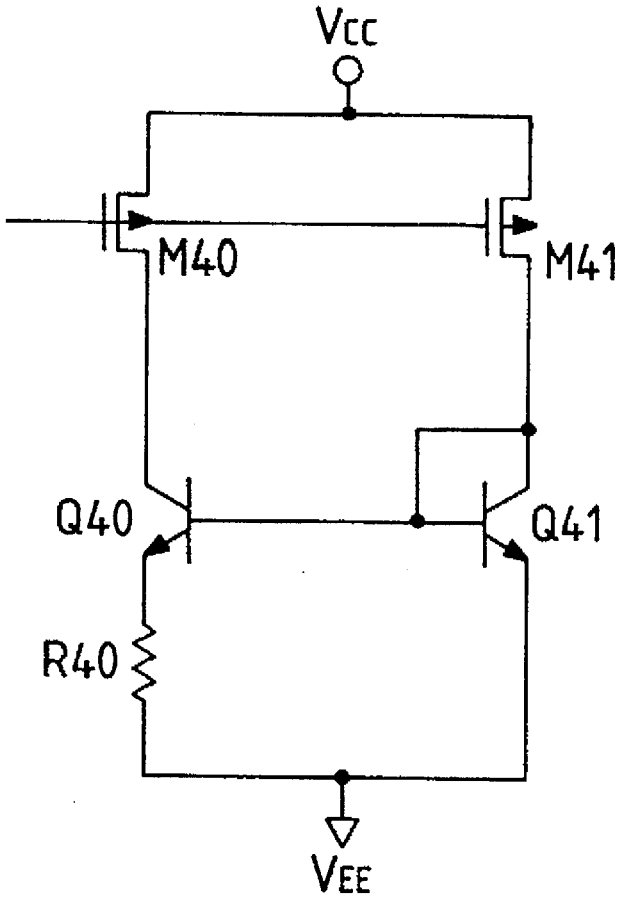
FIG. 23 PRIOR ART
FIG. 23 is a diagram for explaining an influence due to an early effect on MOS transistors in a conventional circuit.

FIG. 23 shows an essence of the circuit disclosed in JP-A-5-233084(1993). Namely, the MOS transistors M41 and M40 have in common their sources and gates to thereby keep the ratio of the collector voltages of the bipolar transistors Q40 and Q41 constant. However, the drain voltage of the MOS transistor M41 is kept at about 0.8 V with reference to VEE potential by means of the bipolar transistor M41. On the other hand, the collector voltage of the bipolar transistor Q40 does not necessarily vary with reference to VEE potential as long as other measures are used, the accuracy of the reference voltage generating circuit is possibly reduced.

The MOS transistors M2 through M10 constitute a circuit for absorbing power source voltage fluctuation. Since the drain voltage of the MOS transistors M12, M13 and M14 vary in like manner as VCC potential even if the power source voltage varies, the variation of the mutual ratios of the drain currents of these MOS transistors due to the power source voltage is cancelled out.

The circuit of the present embodiment provides a LSI use reference current generating circuit which can be operated even with a low power source voltage. Namely, with the present embodiment a reference current which is proportional to ambient absolute temperature and is independent from the power source voltage is obtained.

Figure 14:
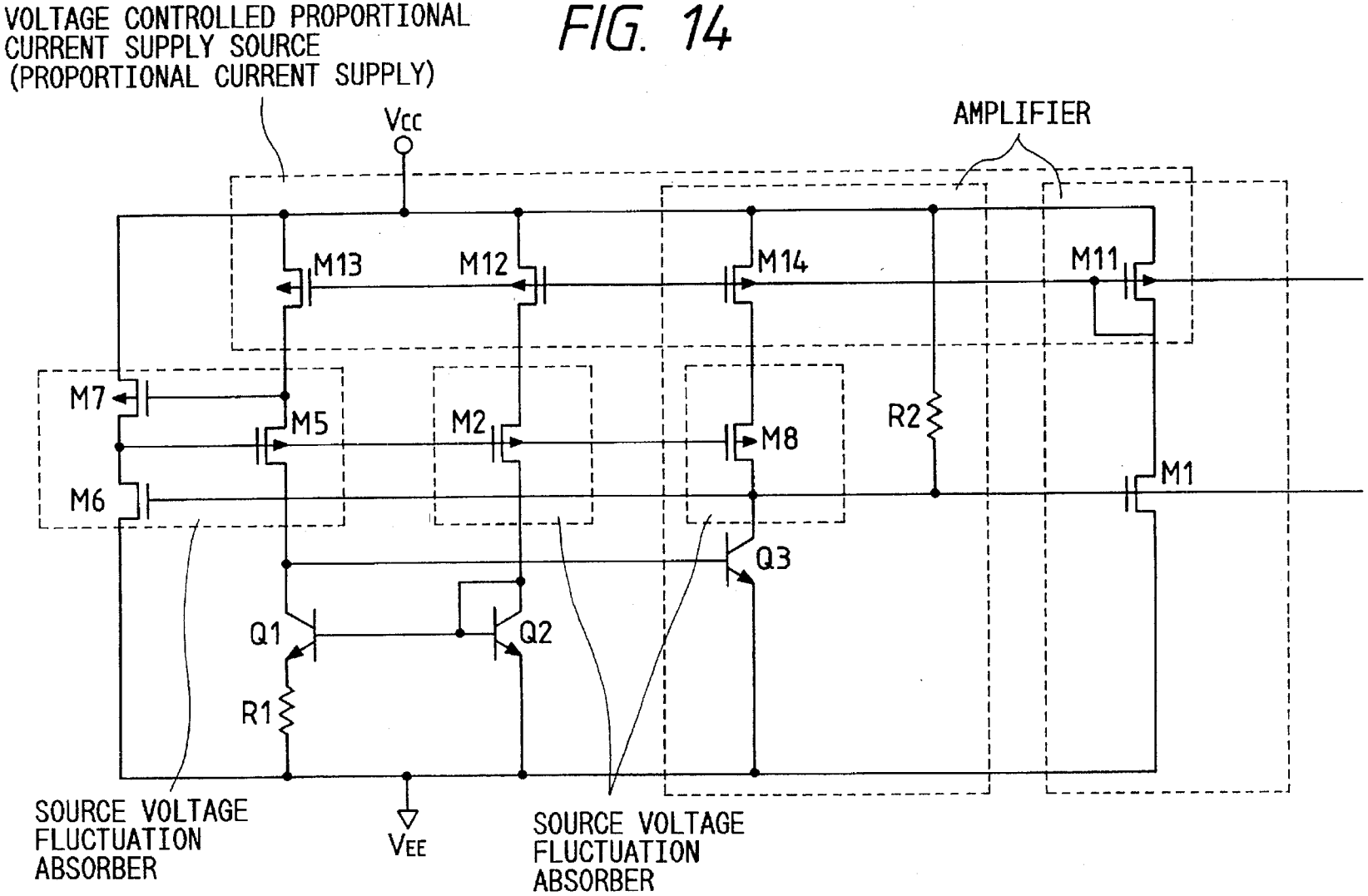
FIG. 14 shows a further example of reference current and reference voltage generating circuits according to the present invention.

FIG. 14 shows another embodiment of the present invention, wherein in place of the MOS transistors M6, M7, M3, M4, M9 and M10 which are separately provided for every MOS transistor constituting the current mirror circuit in FIG. 13, a common set of MOS transistors are used, thereby the number of circuit elements is reduced. The drain voltages of the MOS transistors M11, M12, M13 and M14 show similar dependencies with respect to power source voltage and ambient temperature, therefore the drain potentials of these MOS transistors can be commonly controlled. FIG. 14 shows an example, wherein the MOS transistors M3, M4, M9 and M10 are replaced by the common MOS transistors M6 and M7. However, for example, the MOS transistors M3 and M4 can be used as the common MOS transisters wherein the gate currents of the MOS transistors M5 and M8 can be led out from the drains of the MOS transistors M6 and M7.

According to the present embodiment circuit, the number of circuit elements is reduced in comparison with the FIG. 13 circuit, thereby a reference current generating circuit of a reduced circuit area is realized.

Figure 15:
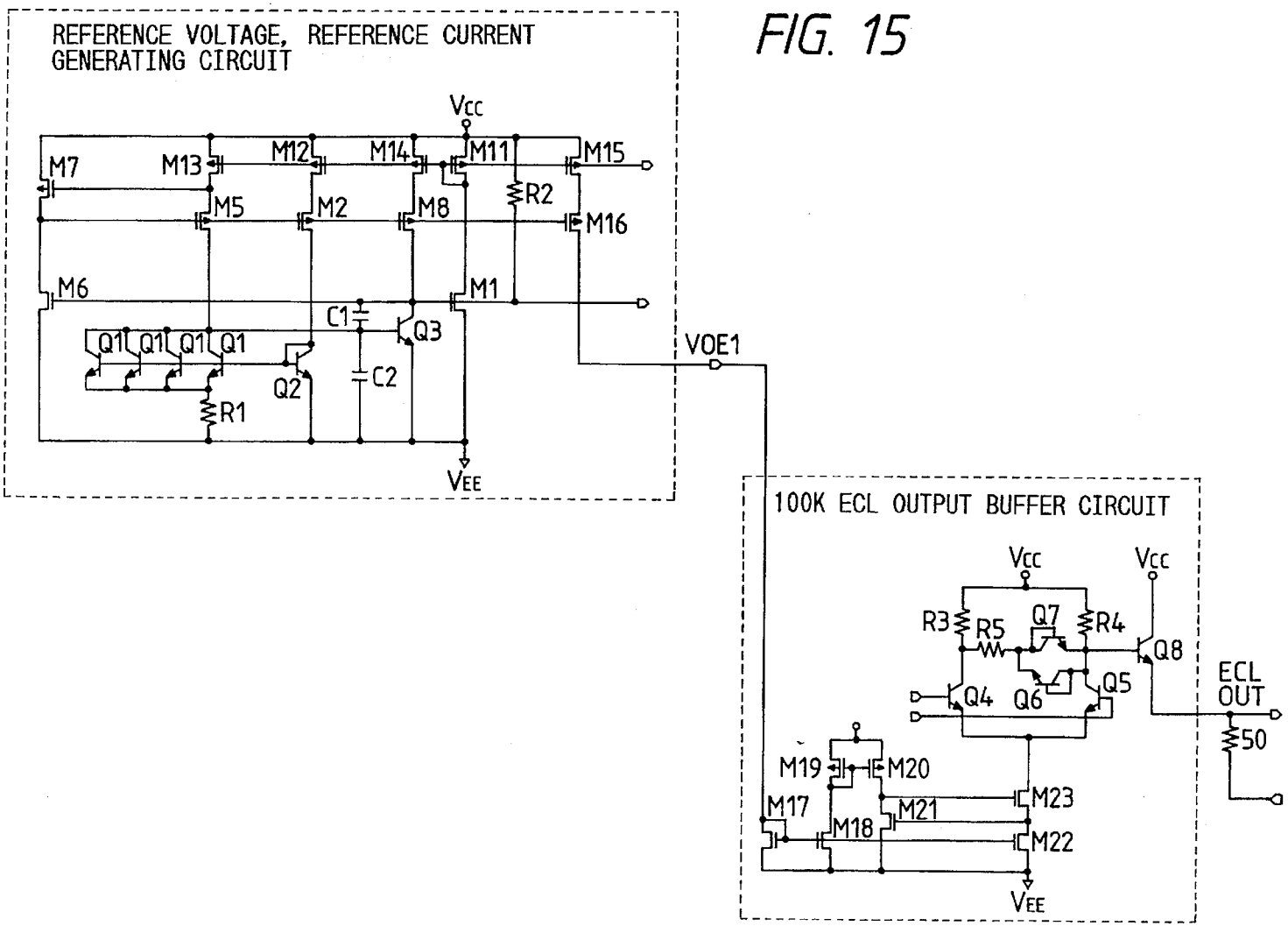
FIG. 15 shows a constitutional example of ECL 100k output buffer circuits using a reference current and reference voltage generating circuit according to the present invention.

FIG. 15 shows an example of output buffer circuits which is constituted by making use of the reference current generating circuit as explained in connection with FIG. 14 and which satisfies the ECL 100k standard as tabulated in FIG. 20, wherein the current source of the ECL 100k output buffer is driven by the reference current outputted from the reference current generating circuit.

The gates and sources of the MOS transistors M15 and M13 are connected in common and the variation of the drain voltages with respect to variation of the power source voltage of these MOS transistors is cancelled out by means of the MOS transistors M16 and M5, therefore the current flowing through the MOS transistor M13 and varying in proportion to ambient temperature also flows through the MOS transistor M15, however, the amplitude of the current is kept independent from the power source voltage. Accordingly, a current having no dependency on the power source voltage but varying in proportion to ambient absolute temperature also flows through the MOS transistor M17 which is connected in series with the MOS transistor M15.

The MOS transistors M17, M18, M19, M20, M21, M22 and M23 constitute a so called regulated cascode current mirror circuit. With this circuit a current proportional to one flowing through the MOS transistor M17 also flows through the MOS transistor M22. The ECL 100k voltage output use current switching circuit, which is constituted by the bipolar transistors Q4, Q5, Q6, Q7 and Q8 and the resistance elements R3, R4 and R5, generates an output voltage which satisfies the 100k ECL standard. Namely, since the voltage generated at both ends of the resistance element R4 shows a positive dependency with respect to ambient absolute temperature and the base-emitter voltage of the bipolar transistor Q8 shows a negative dependency with respect to ambient absolute temperature, a summing voltage of these two voltages (namely a voltage generated between ECLOUT and VCC) is possibly eliminated of its temperature dependency.

Figure 22B:
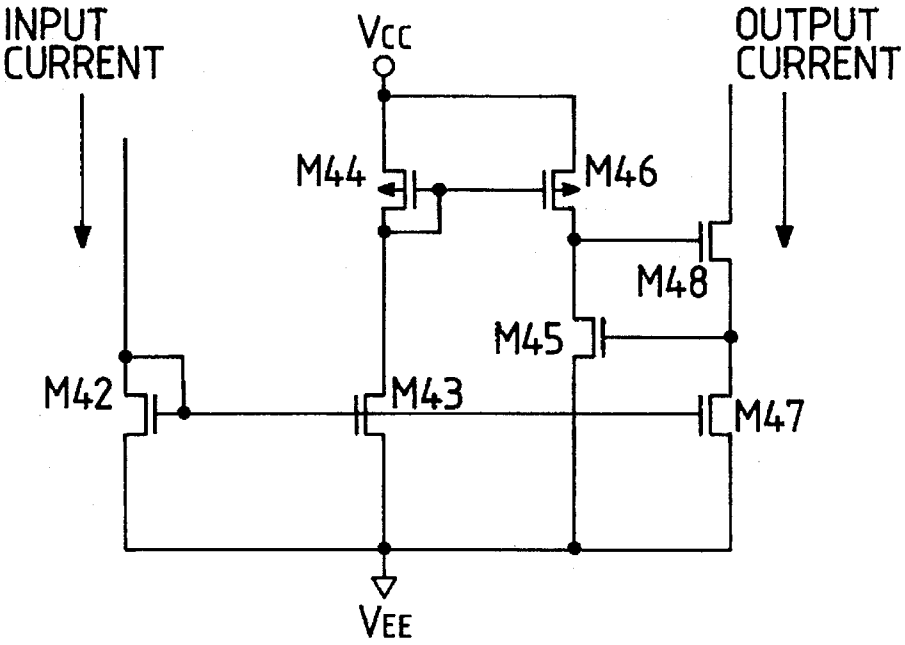
FIG. 22A and FIG. 22B are explanatory diagrams of current mirror circuits in one of which the influence of an early effect of a MOS transistor is reduced.
Figure 22A:
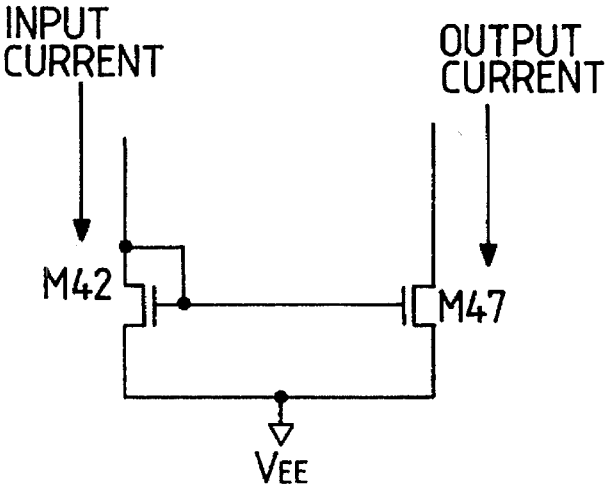

The operation of the regulated cascode . current mirror circuit is explained with reference to FIG. 22A and FIG. 22B. FIG. 22A shows an ordinary current mirror circuit. Namely, the input current inputted into the MOS transistor M42 appears as an output current in a form of the drain current of the MOS transistor M47 of which gate and source are connected in common with the gate and source of the MOS transistor 42. However, since the drain volatge of the MOS transistor M42 and the drain voltage of the MOS transistor M47 are affected differently by the variations of the power source voltage and the ambient temperature, the coincidence accuracy between the input current and the output current is poor. FIG. 22B shows a regulated cascode . current mirror circuit. Likely, in the circuit the inputted current into the MOS transistor M42 is inputted in a form of the drain current of the MOS transistor M47. Since the MOS transistors M43, M44, M46 and M45 are connected with the MOS transistor M42 in a current mirror circuit, a current proportional to the input current also flows through the MOS transistor M45. Accordingly, the gate voltage of the MOS transistor M45, namely the drain voltage of the MOS transistor varies in the same tendency as the gate voltage of the MOS transistor M42, namely the drain voltage of the MOS transistor M42, therefore the poor accuracy due to inconsistency of the drain voltage of the MOS transistor M42 and the drain voltage of the MOS transistor M47 which was experienced in the ordinary current mirror circuit is eliminated.

The data input signal of the output buffer is inputted at the base terminals of the bipolar transistors Q4 and Q5 in FIG. 15 and the data is outputted at the base of the bipolar transistor Q8. The 100k ECL voltage output use current switching circuit constituted by the bipolar transistors Q4, Q5, Q6, Q7 and Q8 and the resistance elements R3, R4 and R5 is known for a person skilled in the art. Further, the capacitors such as C1, C2 and C3 as illustrated in FIG. 15 are for preventing oscillation of the circuit. Still further, the oscillation of the circuit can be also prevented by limiting the amount of the resistance element R5.

Figure 19:
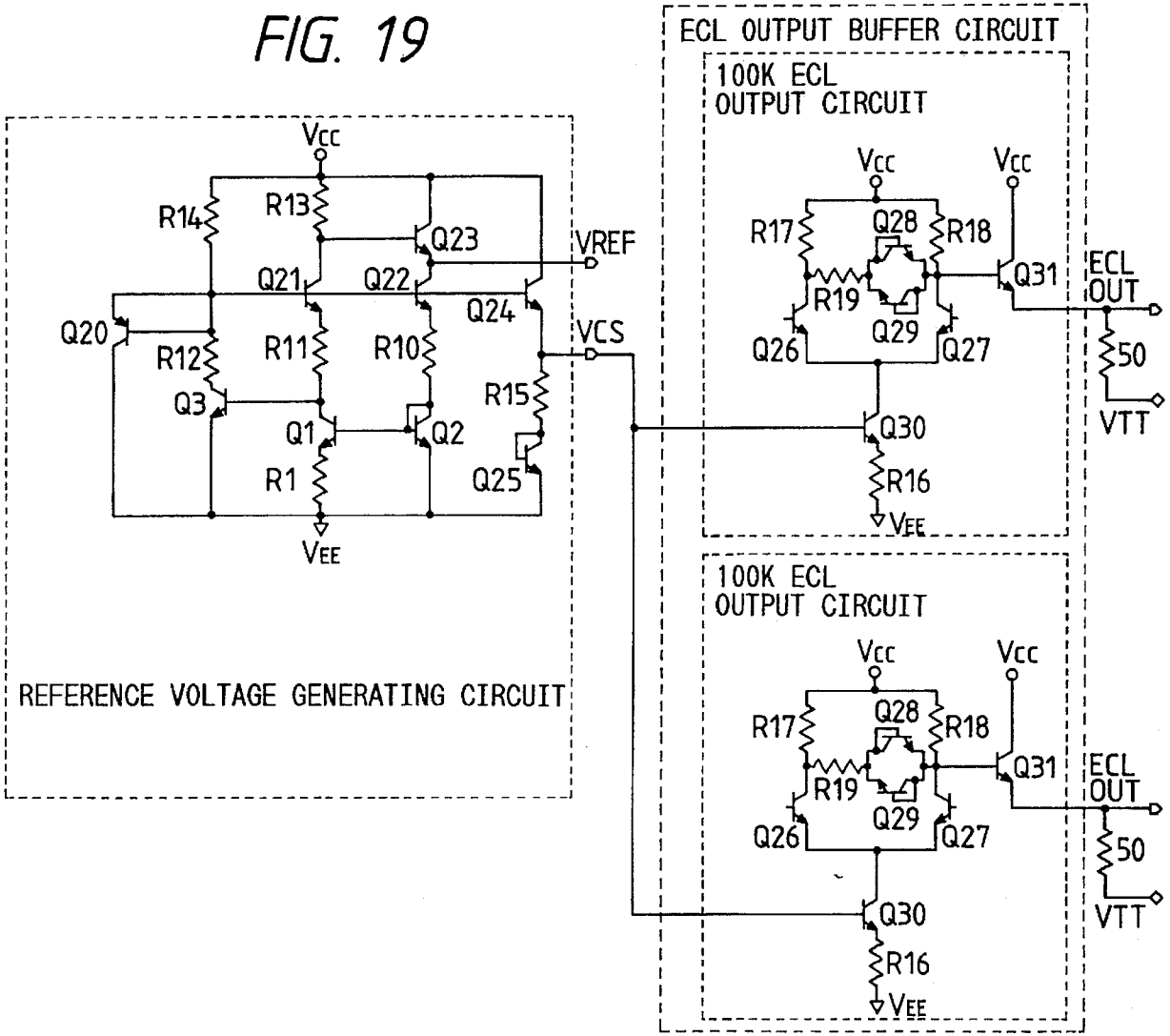
FIG. 19 shows a constitution of a conventional 100k ECL output buffer using a 100k power source.
Figure 21B:
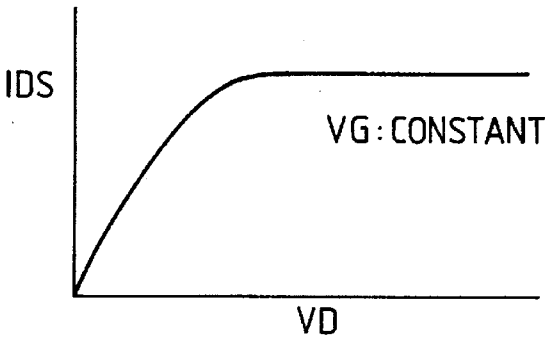
FIG. 21A through FIG. 21C are diagrams illustrating static characteristics of a MOS transistor for explaining an early effect of a MOS transistor.
Figure 21C:
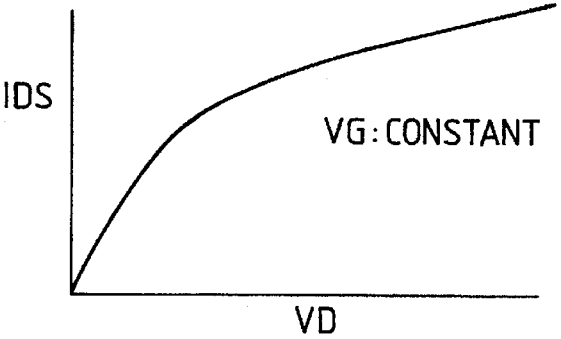
Figure 21A:
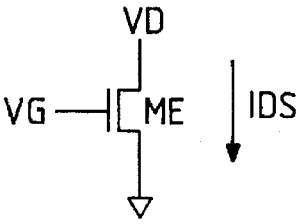

With the FIG. 15 circuit, an output buffer circuit which satisfies the ECL 100k standard can be constituted which is operable with a voltage of 3.0 V or less. Such an output buffer circuit is never saturated because the reference current generating circuit is operable with a low power source voltage of about 3 V and no bipolar transistor Q30 is used in the current source unit as in the conventional 100k ECL output buffer circuit as illustrated in FIG. 19.

In the FIG. 15 circuit, a signal line represented by VOE1 transmits a current signal. Namely, the current generated at the MOS transistor M15 induces the gate voltage of the MOS transistor M17 and the gate voltage induces a constant current at the MOS transistor M22. Therefore, even when a parasitic resistance is large which appears at the signal line of VOE1 between the reference current generating circuit unit and the ECL 100k output buffer circuit unit, the ECL output circuit can generate an accurate output voltage. When it is difficult to accurately transmit a volatge signal in an LSI having a large chip size because of a large physical distance between the reference current generating unit and the ECL output unit within the chip, it is particularly effective to connect the reference generation use power source circuit with the output circuit and the like.

According to the present embodiment, a reference current generating circuit and a constant voltage generating circuit is provided which can be used for an LSI having a large chip size in which a large parasitic resistance appears at the signal wirings and power source wirings. JP-A-3-15916(1991) discloses a circuit arrangement wherein from the power source circuit to the ECL logic circuit are connected by a current signal, however the power source circuit uses the above indicated conventional measures for the power source circuit the circuit cannot be operated with a low power source voltage of which the present invention contemplates.

Figure 16:
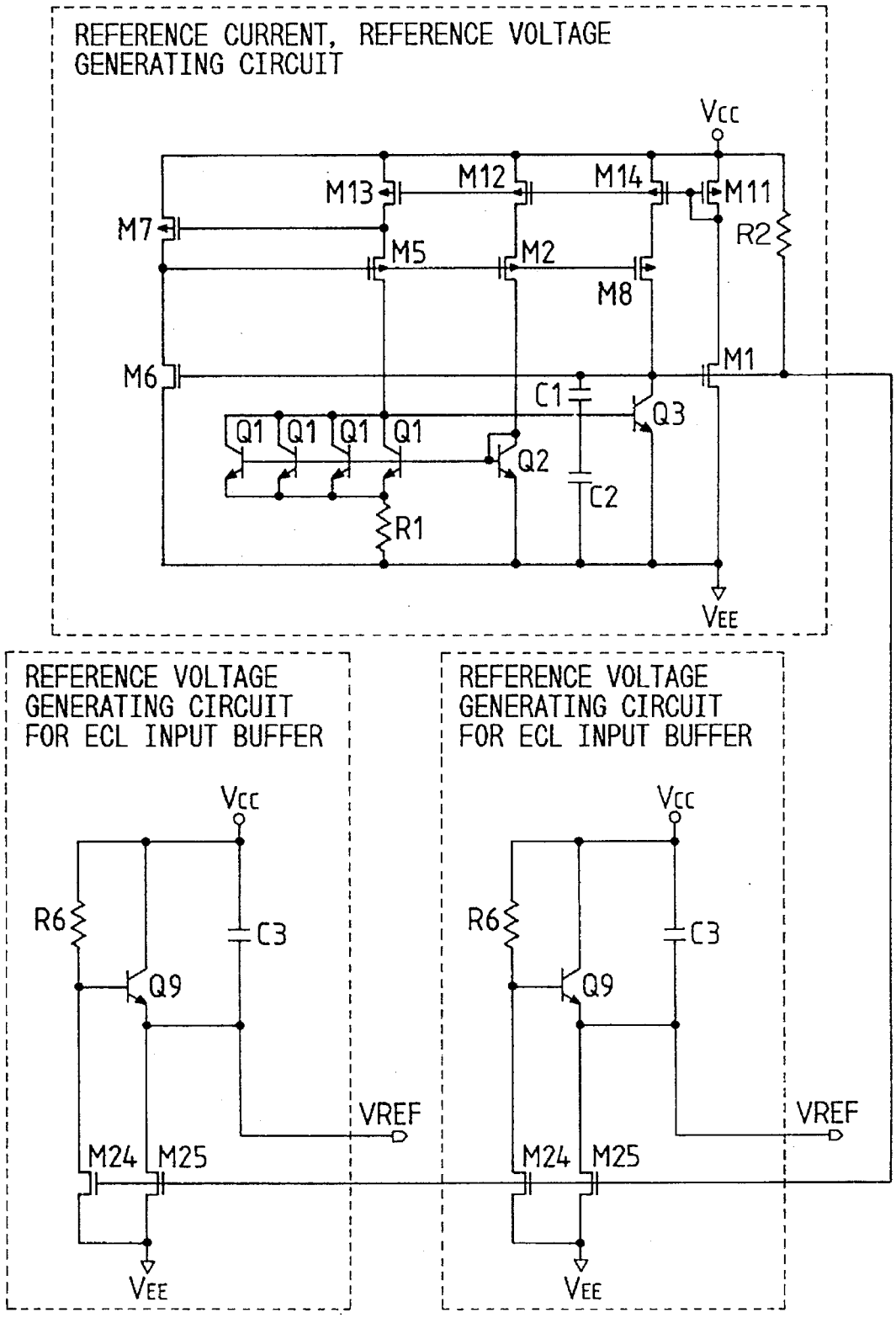
FIG. 16 shows a constitutional example of an ECL input buffer for reference voltage generating circuits using a reference current and reference voltage generating circuit according to the present invention.

FIG. 16 shows an example of input buffer circuit use reference voltage generating circuits which is constituted by making use of the reference current generating circuit as illustrated in FIG. 14 and which satisfies the ECL 100k standard.

By flowing a current generated at the reference current generating circuit and varying in proportion to ambient absolute temperature through the MOS transistor M24 a voltage varying in proportion to the ambient absolute temperature is generated at both ends of the resistance element R6. By adding the thus generated voltage and the base-emitter voltage of the bipolar transistor Q9 having negative temperature dependency, a voltage VREF having no dependencies both with respect to power source voltage and ambient temperature and determined with reference to the power source terminal potential VCC obtained at the output terminal VREF. The obtained voltage can be used as a reference voltage for the ECL input buffer.

Figure 17:
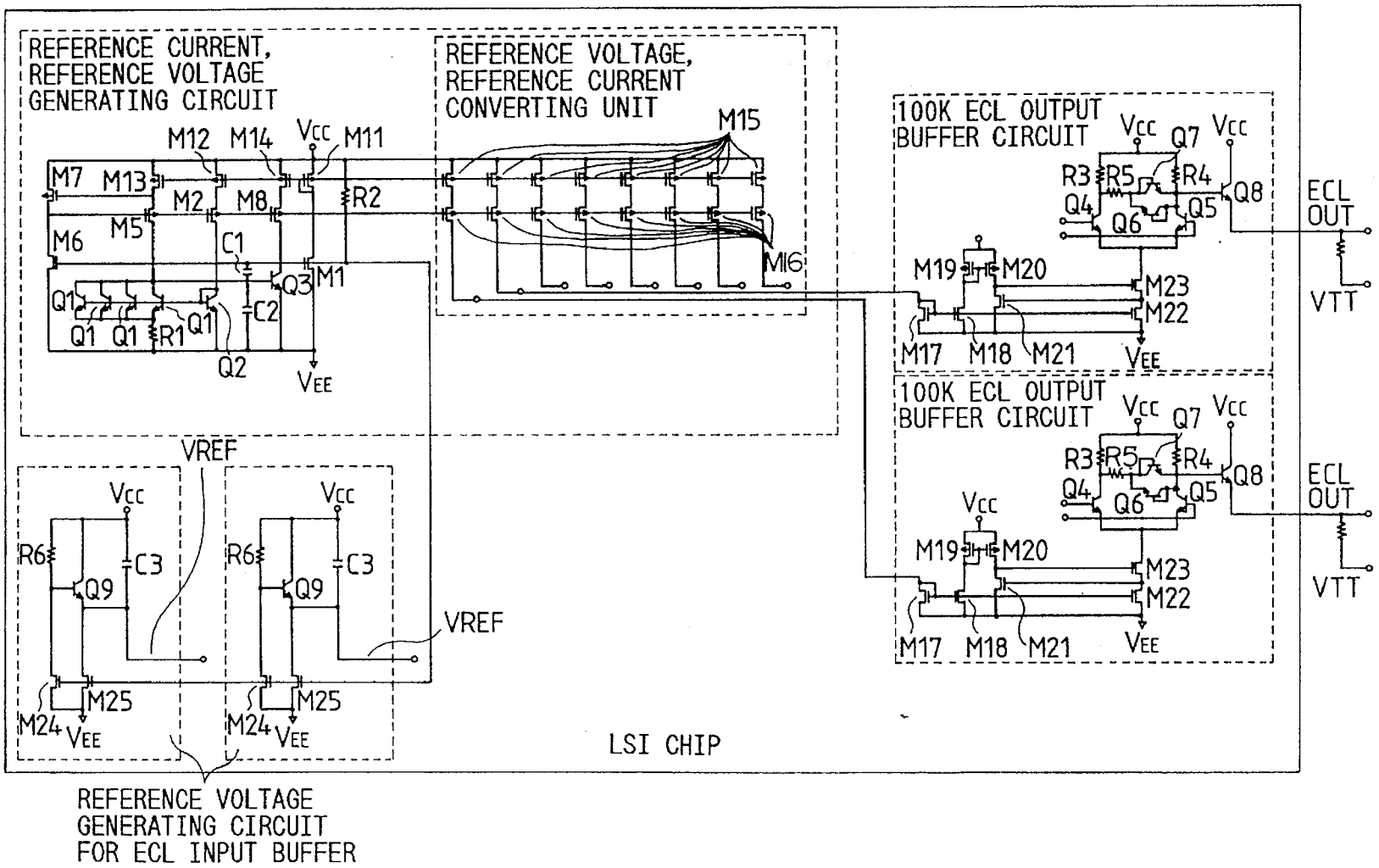
FIG. 17 is shows a constitutional example of an ECL LSI for power source circuits using a reference current and reference voltage generating circuit according to the present invention.

FIG. 17 shows an example of input and output use power source circuits in an ECL 100k LSI including both the ECL output buffer circuit as has been already explained and the ECL input buffer circuit use reference voltage generating circuit.

According to the present embodiment, if the reference current generating circuit, the ECL input buffer use reference voltage generating circuit and the ECL output buffer circuit which are roughly classified are provided within a chip, a LSI chip which satisfies the ECL 100k standard can be constituted. As illustrated in the drawing, the reference current generating unit is commonly used for the input circuit and the output circuit, therefore, the number of the circuits within the chip can be reduced in comparison with the instance wherein separate reference current generating units are prepared for the respective circuits.

Figure 18:
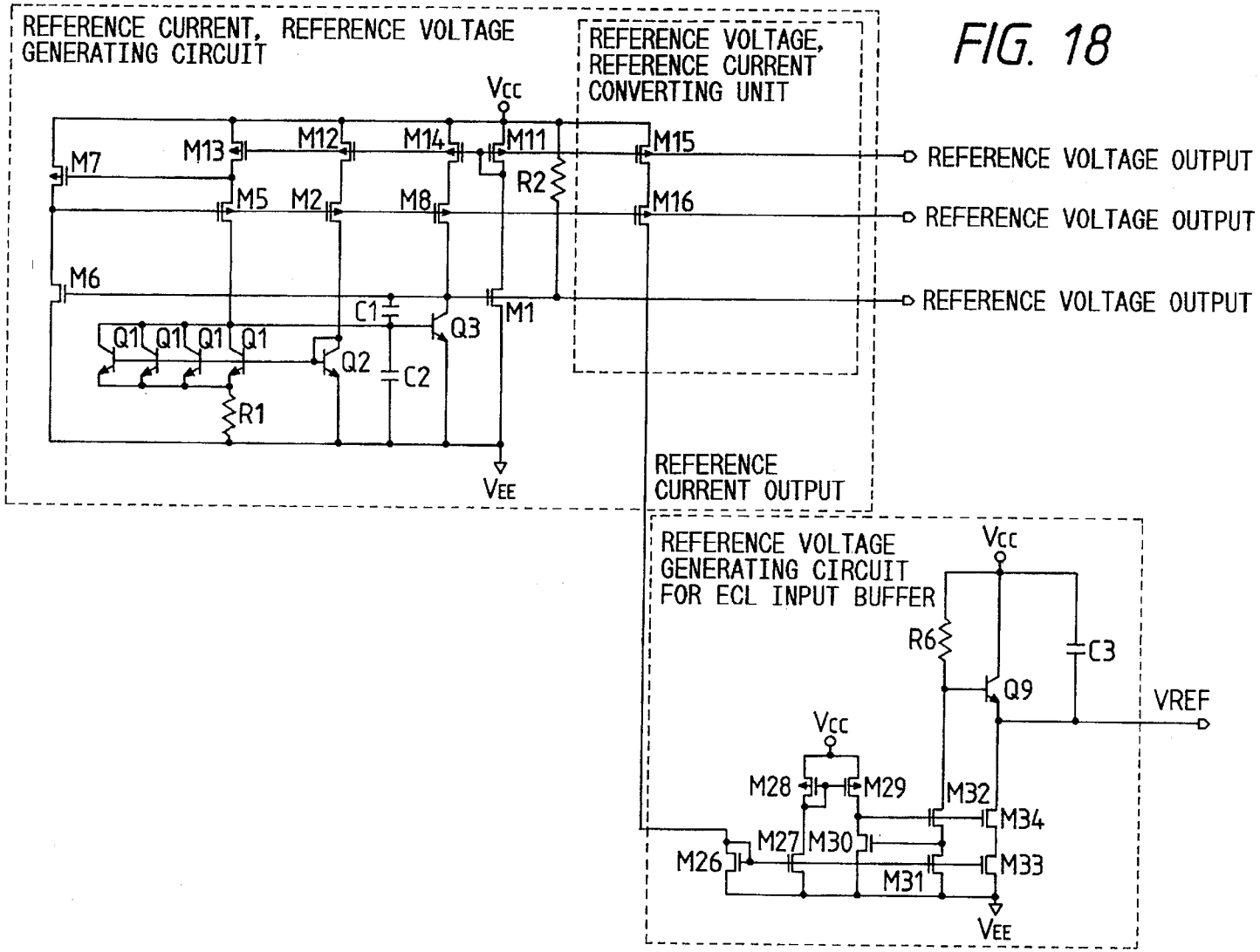
FIG. 18 shows another constitutional example of an ECL input buffer for reference voltage generating circuits using a reference current and reference voltage generating circuit according to the present invention.

FIG. 18 shows another example of ECL 100k input buffer use reference voltage generating circuits which is constituted by making use of the reference current generating circuit, wherein the current source which is constituted by MOS transistors M24 and M25 in the FIG. 16 circuit is constituted by MOS transistors M26, M27, M28, M29, M30, M31, M32, M33, M34 and M35. These MOS transistors constitute a regulated . cascode current mirror circuit as illustrated in FIG. 15 which supplies to the resistance element R6 a current independent from the variation of the power source voltage as well as varying in proportion to the ambient absolute temperature.

With the FIG. 18 circuit, an ECL LSI input circuit use reference voltage generating circuit which is operable with a low power source voltage is obtained. This is because the reference current generating circuit therein is operable with a low power source voltage.

Accordingly to the present invention, a reference current generating circuit can be constituted which generates a reference current having no power source voltage dependency and varying in proportion to the ambient absolute temperature.

According to the present invention, a reference current generating circuit which is operable with a low power source voltage of 3 V or less can be constituted.

According to the present invention, a reference current generating circuit can be constituted even in an LSI chip having a large chip size in which there exists a large power source potential distribution.

According to the invention, a reference current generating circuit is obtained which is operable with a low power source voltage and generates a reference current indepedent from the power source voltage and varying in proportion to the ambient absolute temperature.

According to the present invention, an LSI which satisfies the ECL 100k standard can be constituted by making use of the above reference current generating circuit.

Further, according to the present invention, an LSI which satisfies the ECL 100k standard can be realized even for a LSI having a large chip size, a large parasitic resistance of the power source wirings and a large power source potential distribution.

We claim:

1. A constant current generating circuit comprising:

a first current generating circuit unit which generates a first current having a predetermined positive temperature dependency characteristic, said first current generating circuit unit including a pair of first and second bipolar transistors having bases which are connected to each other and having emitters which are connected to each other via a first resistor, wherein the base and the collector of said second bipolar transistor are connected to each other, said first current generating circuit unit further including a first current mirror circuit comprised of a plurality of first MOS transistors which regulates a current density ratio of the currents fed to said first and second bipolar transistors to be constant and derives the first current having the predetermined positive temperature dependency characteristic which corresponds to a differential voltage between the base-emitter voltages of said first and second bipolar transistors appearing across the first resistor;

a second current generating circuit unit which generates a second current having a predetermined negative temperature dependency characteristic, said second current generating circuit unit including a third bipolar transistor and a second resistor which is connected between the base and the emitter of said third bipolar transistor and through which the second current having the predetermined negative temperature dependency characteristic is derived; and a summing current generating circuit unit which sums the first current having the predetermined positive temperature dependency characteristic from said first current generating circuit unit and the second current having the predetermined negative temperature dependency characteristic from said second current generating circuit unit and which generates a constant current with substantially no temperature dependency representing the summed current, wherein said first current generating circuit unit further includes a first circuit means disposed between the pair of said first and second bipolar transistors and said first current mirror circuit for limiting dependency of the currents flowing through said first and second bipolar transistors on a voltage of a power source applied to said first current mirror circuit;

wherein said summing current generating circuit unit includes a second current mirror circuit comprised of a plurality of second MOS transistors which generates the constant current representing the summed current.

2. A constant current generating circuit comprising:

a first current generating circuit unit which generates a first current having a predetermined positive temperature dependency characteristic, said first current generating circuit unit including a pair of first and second bipolar transistors having bases which are connected to each other and having emitters which are connected to each other via a first resistor, wherein the base and the collector of said second bipolar transistor are connected to each other, said first current generating circuit unit further including a first current mirror circuit comprised of a plurality of first MOS transistors which regulates a current density ratio of the currents fed to said first and second bipolar transistors to be constant and derives the first current having the predetermined positive temperature dependency characteristic which corresponds to a differential voltage between the base-emitter voltages of said first and second bipolar transistors appearing across the first resistor;

a second current generating circuit unit which generates a second current having a predetermined negative temperature dependency characteristic, said second current generating circuit unit including a third bipolar transistor and a second resistor which is connected between the base and the emitter of said third bipolar transistor and through which the second current having the predetermined negative temperature dependency characteristic is derived; and a summing current generating circuit unit which sums the first current having the predetermined positive temperature dependency characteristic from said first current generating circuit unit and the second current having the predetermined negative temperature dependency characteristic from said second current generating circuit unit and which generates a constant current with substantially no temperature dependency representing the summed current, wherein said first current generating circuit unit further includes a first circuit means disposed between the pair of said first and second bipolar transistors and said first current mirror circuit for limiting dependency of the currents flowing through said first and second bipolar transistors on a voltage of a power source applied to said first current mirror circuit;

wherein said summing current generating circuit unit includes a regulated cascode current mirror circuit comprised of a plurality of third MOS transistors which generates the constant current with substantially no dependency on fluctuating voltage from the power source due an early effect inherent to the third MOS transistors representing the summed current.

3. A constant current generating circuit according to claim 2, wherein said summing current generating circuit unit further includes a second circuit means which provides the summed current with a predetermined negative dependency on fluctuating voltage from the power source.

4. A constant current generating circuit according to claim 2, wherein said first current mirror circuit in said first current generating circuit unit further includes a third circuit means comprised of a plurality of fourth MOS transistors which substantially eliminates dependency of the first current derived from said first current mirror circuit on fluctuating voltage from the power source due to an early effect inherent to the first MOS transistors for said first current mirror circuit.

* * * * *